US012188490B2

(12) United States Patent
Turner

(10) Patent No.: US 12,188,490 B2
(45) Date of Patent: Jan. 7, 2025

(54) OXYHYDROGEN PULSE AND ROTARY DETONATION COMBUSTION PUMP

(71) Applicant: Vance Turner, San Andreas, CA (US)

(72) Inventor: Vance Turner, San Andreas, CA (US)

(73) Assignee: Vance Turner, San Andreas, CA (US)

( * ) Notice: Subject to any disclaimer, the term of this patent is extended or adjusted under 35 U.S.C. 154(b) by 684 days.

(21) Appl. No.: 16/989,838

(22) Filed: Aug. 10, 2020

(65) Prior Publication Data

US 2021/0040961 A1 Feb. 11, 2021

Related U.S. Application Data

(60) Provisional application No. 62/884,589, filed on Aug. 8, 2019.

(51) Int. Cl.
*F04F 1/16* (2006.01)

(52) U.S. Cl.
CPC ..... *F04F 1/16* (2013.01)

(58) Field of Classification Search
CPC ..... F04F 1/16
See application file for complete search history.

(56) References Cited

U.S. PATENT DOCUMENTS 46,683 A * 3/1865 Linton ..... F04F 1/16 417/73
379,674 A * 3/1888 Bolmer ..... F04F 1/16 417/73
779,499 A * 1/1905 Rice ..... F04F 1/16 417/73
1,027,430 A * 5/1912 Poore ..... F04F 1/16 417/74
1,084,340 A * 1/1914 Humphrey ..... F04F 1/18 417/54
1,158,303 A * 10/1915 Schafer ..... F04B 9/10 417/74
1,259,338 A * 3/1918 Alexanderson ..... F04B 9/10 417/74
1,271,712 A 7/1918 Humphrey et al.
1,272,269 A 7/1918 Humphrey
(Continued)

FOREIGN PATENT DOCUMENTS

CH 69680 A 7/1915
CN 104792534 A 7/2015
(Continued)

OTHER PUBLICATIONS

Fondriest Environmental Learning Center Webpage, captured on Apr. 25, 2019 by the Wayback Machine (archive.org), https://web.archive.org/web/20190425171307/https://www.fondriest.com/environmental-measurements/parameters/water-quality/ph/ (Year: 2019).*
International Preliminary Report on Patentability for International Application PCT/US2020/045681, Report issued Feb. 8, 2022, Mailed on Feb. 17, 2022, 09 Pgs.
(Continued)

*Primary Examiner* — Bryan M Lettman
(74) *Attorney, Agent, or Firm* — KPPB LLP

(57) ABSTRACT

A pump capable of producing both positive pressure and a vacuum. The pump utilizes a combustion chamber and various valve assemblies. The pump operates via a process of internal gas combustion combined with the movement of fluid within a combustion chamber and various valve assemblies. The combustion of gas and fluid movement creates a force that is harnessed to generate vacuum or pressure from the combustion process.

20 Claims, 18 Drawing Sheets

(56) References Cited

U.S. PATENT DOCUMENTS

| | | | | |
|---|---|---|---|---|
| 1,626,070 | A | 4/1927 | Bond et al. | |
| 3,586,461 | A * | 6/1971 | Erlandson | F04F 1/16 417/246 |
| 3,787,144 | A * | 1/1974 | Wood | E02F 3/8883 417/74 |
| 3,862,624 | A * | 1/1975 | Underwood | F02B 47/08 123/3 |
| 3,897,173 | A * | 7/1975 | Mandroian | F04F 1/16 60/634 |
| 6,116,030 | A * | 9/2000 | Story | F04F 5/466 62/7 |
| 2013/0118446 | A1 * | 5/2013 | Dolan | B63H 11/14 123/25 C |
| 2015/0345516 | A1 | 12/2015 | Fisher | |
| 2016/0195076 | A1 | 7/2016 | Rivard | |
| 2016/0305320 | A1 * | 10/2016 | Orellana Hurtado | F02C 3/22 |

FOREIGN PATENT DOCUMENTS

| | | | |
|---|---|---|---|
| CN | 114502845 | A | 5/2022 |
| DE | 3118867 | A1 | 12/1982 |
| EP | 4010600 | A1 | 6/2022 |
| FR | 441560 | A | 8/1912 |
| KR | 20220050909 | A | 4/2022 |
| WO | 2021026543 | A1 | 2/2021 |

OTHER PUBLICATIONS

International Search Report and Written Opinion for International Application No. PCT/US2020/045681, Search completed Oct. 8, 2020, Mailed Oct. 22, 2020, 15 Pgs.

Extended European Search Report for European Application No. 20851058.6, Search completed Jul. 28, 2023, Mailed Aug. 7, 2023, 9 Pgs.

* cited by examiner

OXYHYDROGEN PULSE AND ROTARY DETONATION COMBUSTION PUMP

CROSS REFERENCE TO RELATED APPLICATIONS

This application claims priority to U.S. Provisional Application Ser. No. 62/884,589, entitled "Hydrogen Pulse Detonation Combustion Pump" by Vance Turner, filed Aug. 8, 2019, the disclosure of which is incorporated herein by reference in its entirety.

FIELD OF THE INVENTION

This application generally relates to vacuum and pressure pumps and the various applications of such pumps. More specifically, this application relates to the use of detonation combustions, some of which can be centered on the relationship of hydrogen, oxygen, and water to generate high pressures and vacuums within a short period and harnessing the shockwave, implosion, matter state changes, and high thermal energies created with the aim of improving the efficiency of such pumps.

BACKGROUND

Pumps are generally well known in the field and have been used in a variety of different applications today including automotive, commercial and industrial applications, and many others. Pumps, including vacuum pumps, have been used in a variety of industries including the production and manufacture of composite materials, electronic components such as integrated circuits and printed circuit boards as well as a variety of many other industries. In some applications, the use of vacuum pumps and being able to maintain vacuum can be essential to the operation at hand. Furthermore, it can mean the difference between producing high quality products and those with defects. Additionally, in a variety of applications pumps can serve as life sustaining devices and thus it is essential that they are reliable, predictable, and durable in the use and function thereof.

Traditional pumps, including vacuum pumps, which are typically used in industry rely on a multitude of mechanical components to generate the vacuum and/or pressure necessary for the desired use. For example, a vacuum cleaner may use an electric motor to move the air molecules from one area to another in order to generate a partial vacuum. Systems such as these typically involve some type of positive displacement system to move the air molecules around in order to generate vacuum. Many such systems have large motors that produce vast amounts of noise and can take time to reach the vacuum desired for operation. For example, some systems may take five or more minutes to generate the necessary vacuum to operate. The increased size of motors as well as the greater time required can lead to higher energy costs for many users.

SUMMARY OF THE INVENTION

Many embodiments are directed to a combustion pump that is capable of producing work by operating on the principle of producing a pulse detonation combustion which performs work by expansion of a gas. Further work can be done by atmospheric compression and/or condensation of the expanded gas.

Numerous embodiments are directed to a combustion chamber with an exterior portion and an interior portion wherein the interior portion forms an internal space. The combustion chamber is outfitted with a fluid inlet and outlet valve assembly that is in fluid communication with the interior portion of the combustion chamber having a portion thereof connected to the exterior portion of the combustion chamber, wherein the inlet valve assembly receives a predetermined amount of fluid to be placed in the internal portion of the combustion chamber. Additionally, the combustion chamber is outfitted with a gas inlet valve assembly in fluid communication with the interior portion of the combustion chamber and connected to the exterior portion and configured to transfer a combustible gas into the internal portion of the combustion chamber, and an ignition source connected to the exterior portion of the combustion chamber and exposed to the interior portion of the combustion chamber.

In other embodiments, the pulse detonation pump has a fluid outlet valve assembly, wherein the fluid outlet valve assembly is in fluid communication with the interior portion of the combustion chamber whereby the pressure on the portion of the amount of fluid drives the fluid through the fluid outlet assembly into a fluid management system.

In still other embodiments, the fluid management system is one or more pipes connected to the outlet valve assembly.

In yet other embodiments, the one or more pipes are connected to a storage reservoir.

In still yet other embodiments, the detonation of the combustible gas further generates a vacuum within the combustion chamber such that an additional amount of fluid can be drawn into the combustion chamber through the fluid inlet assembly by the difference in pressure between the vacuum state and atmospheric pressure.

In other embodiments, the fluid inlet assembly further comprises a fluid valve configured to open and close during one or more points of a combustion cycle within the combustion chamber.

In still other embodiments, the gas inlet assembly further comprises a gas valve configured to open and close during one or more points of a combustion cycle within the combustion chamber.

In yet other embodiments, the pulse detonation pump has an exhaust port.

In still yet other embodiments, the ignitor assembly has a first portion that generates an ignition and a second portion that houses the generated ignition and wherein the first portion is not exposed to the interior of the combustion chamber and the second portion is disposed within the combustion chamber and exposed to the combustible gases.

In other embodiments, the pulse detonation pump has a view port connected to the external portion of the combustion chamber and extending through to the internal portion of the combustion chamber such that the interior can be viewed and inspected from the exterior of the combustion chamber.

In still other embodiments, the pulse detonation pump has at least one sensor disposed on the interior of the combustion chamber.

In yet other embodiments, the sensor is configured to measure the amount of combustible gas within the combustion chamber.

In still yet other embodiments, the pulse detonation pump has a control system electronically connected to the fluid inlet assembly, the gas inlet assembly, and the ignitor assembly wherein the control system can monitor and control the detonation of the combustible gases as well as the flow of fluid and combustible gas within the combustion chamber.

In other embodiments, the fluid is selected from a group consisting of water, hydrogen, oxygen, and mercury.

In still other embodiments, the combustible gas is a mixture of hydrogen and oxygen.

In yet other embodiments, the mixture ratio of hydrogen to oxygen is 2 to 1.

In still yet other embodiments, the ignitor is selected from a group consisting of a spark plug, laser, and an electrically heated wire.

Other embodiments include a process of generating vacuum where a combustible gas is received into a combustion chamber. The combustible gas is subsequently ignited in the chamber thereby generating a pressure forcing any fluid within the combustion chamber out of an exit valve such that the pressure inside the combustion chamber is lower than the pressure outside the combustion chamber.

Other embodiments include a process of pumping a fluid using the following steps:

a) Having a pump wherein the pump comprises a combustion chamber having an exterior portion and an interior portion wherein the interior portion forms an internal space,
   at least one fluid inlet assembly in fluid communication with the interior portion of the combustion chamber having a portion thereof connected to the exterior portion of the combustion chamber,
   a gas inlet assembly in fluid communication with the interior portion of the combustion chamber and connected to the exterior portion and configured to transfer a combustible gas into the internal portion of the combustion chamber, and
   an ignitor assembly connected to the exterior portion of the combustion chamber and wherein a section of the ignitor assembly is exposed to the interior portion of the combustion chamber and wherein the ignitor assembly contains an ignitor;
b) receiving water into the combustion chamber through the fluid inlet assembly;
c) receiving a combustible gas into the combustion chamber through the gas inlet assembly;
d) igniting the combustible gas with the activation of the ignitor;
e) producing a detonation of the combustible gas thereby forcing the water out of the combustion chamber through an exit valve connected to a portion of the combustion chamber and wherein the detonation and expulsion of the water further generates vacuum within the combustion chamber by which additional water is received into the combustion chamber.

In yet other embodiments, the combustible gas is a combination of hydrogen and oxygen.

Other embodiments include a rotary detonation pump with a housing that has a continuous side wall forming a chamber between an inner portion of the side wall. The rotary detonation pump also has a primary fluid gallery concentrically disposed within the chamber such that a gap between the continuous sidewall and the primary fluid gallery is formed thereby creating a concentrically located opening and wherein the opening is configured to receive a mixture of combustible gas through an inlet. The gas can be ignited by an ignitor disposed between the inlet and the concentrically located opening where in the ignitor operates to ignite the combustible gas within the concentrically located opening forming a combustion chamber. Additionally, a fluid inlet can be connected to the chamber and the primary fluid gallery by at least one channel, wherein a combustion within the combustion chamber operates to generate vacuum thereby drawing fluid into the pump from atmospheric pressure.

Additional embodiments and features are set forth in part in the description that follows, and in part will become apparent to those skilled in the art upon examination of the specification or may be learned by the practice of the disclosure. A further understanding of the nature and advantages of the present disclosure may be realized by reference to the remaining portions of the specification and the drawings, which forms a part of this disclosure.

BRIEF DESCRIPTION OF THE DRAWINGS

The description will be more fully understood with reference to the following figures, which are presented as exemplary embodiments of the invention and should not be construed as a complete recitation of the scope of the invention, wherein.

DETAILED DESCRIPTION OF THE INVENTION

Figure 1B:
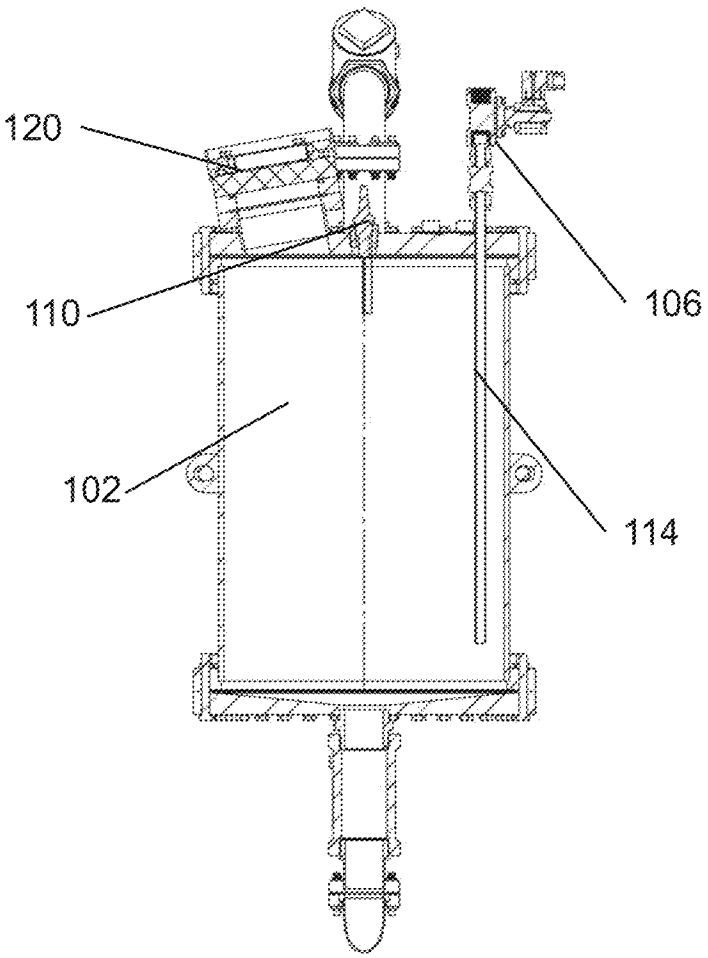
FIGS. 1A-1E illustrate various views of a pulse detonation pump in accordance with embodiments of the invention.

Turning now to the drawings, a pulse detonation combustion pump is described herein. In many embodiments, the pulse detonation pump can include a combustion chamber that receives a supply of combustible gases through an inlet valve. In various embodiments, the pulse detonation pump may have an exit valve connected to the combustion chamber such that an exhaust or a fluid may exit the combustion chamber. In various embodiments the exit valve can be connected to a fluid management system such as piping to direct the flow of the exit fluid or exhaust into any number of additional systems such as energy management systems and/or fluid storage systems. Numerous embodiments, have a fluid inlet valve connected to the combustion chamber to allow for a fluid such as water to be drawn into the combustion chamber during the combustion cycle. Other embodiments, may be configured with an ignition source that is connected to the combustion chamber, more specifically the internal cavity of the combustion chamber, such that it can ignite the gases within the chamber. In accordance with many embodiments the pulse detonation combustion pump is configured to operate in a cyclic fashion. For example, in many embodiments a primer phase will operate to inject the combustion gas into the combustion chamber through the gas inlet valve. Subsequently, the gas can be ignited causing a detonation within the chamber by which any contents within the chamber can be expelled or moved out of the chamber through the fluid exit valve. This can be either gases, liquids, or both. The detonation, in many embodiments can result in a condensation of the combusted gases which can subsequently generate a vacuum within the chamber that can act to draw additional combustible gases and additional fluids into the chamber. The fluids that are used within the chamber and ultimately used for work, can vary depending on the overall desired function and purpose of the pump. For example, some embodiments may utilize liquid water. Other embodiments may use liquid mercury or any other type of fluid that is not reactive with the combustible gas mixture or any component of the pump. Accordingly, it can be appreciated that the structure of the pump can be made of any type of material or combination of materials that is suitable for the intended use of the pulse detonation pump.

There are varieties of vacuum pumps that can be found to create vacuum for a variety of uses. Some such uses may include providing vacuum during a curing cycle in an oven or providing vacuum for the manufacture of multiple components including but not limited to electronic components such as circuit boards and integrated circuits. A traditional vacuum pump operates by altering the pressure in a sealed volume to create at least a partial vacuum. This is typically done by removing the gas molecules within the sealed volume, thus leaving behind a partial vacuum.

As previously described, these traditional systems are made of multiple mechanical components such as rotating fan blades that are connected to a motor system that operates to spin the fan. Mechanical systems are often limited in the strength of the components of which they are made. For example, many such mechanical systems are only designed to operate for a certain number of cycles before failure. Furthermore, such mechanical systems often take time to generate sufficient vacuum and are often noisy. Additionally, in order to generate industrial scales of vacuum some systems tend to be correspondingly large resulting in costly facility and maintenance costs.

Some systems, such as the Humphrey pump, incorporate the idea of reducing the number of moving parts in a pump to generate efficient pumping capabilities through the use of a combustion effect. Some of such examples are illustrated in a variety of patents including but not limited to U.S. Pat. Nos. 1,271,712, 1,272,269, and 1,084,340 to Humphrey. Each of the disclosed Humphrey pumps operated on an open system where one or more components were open to the atmosphere and exposed to the surrounding environment. Additionally, the Humphrey pump lacked the ability to generate suction which required the pump to be located below the fluid source. Furthermore, the Humphrey pump was often large and relatively inconvenient.

In contrast to many present day pumps, embodiments described herein illustrate a pulse detonation pump with relatively few moving mechanical components and capable of generating pressure as well as vacuum that can be applied in a number of different applications. The reduction in moving components can provide several desirable characteristics of an effective pump including, but not limited to, lower maintenance costs, noise reduction, and improved operating efficiency. For example, some embodiments are capable of generating high levels of pressure and vacuum in a matter of milliseconds whereas traditional pumps would take several minutes to obtain comparable levels.

Embodiments of the Pump

Figure 1A:
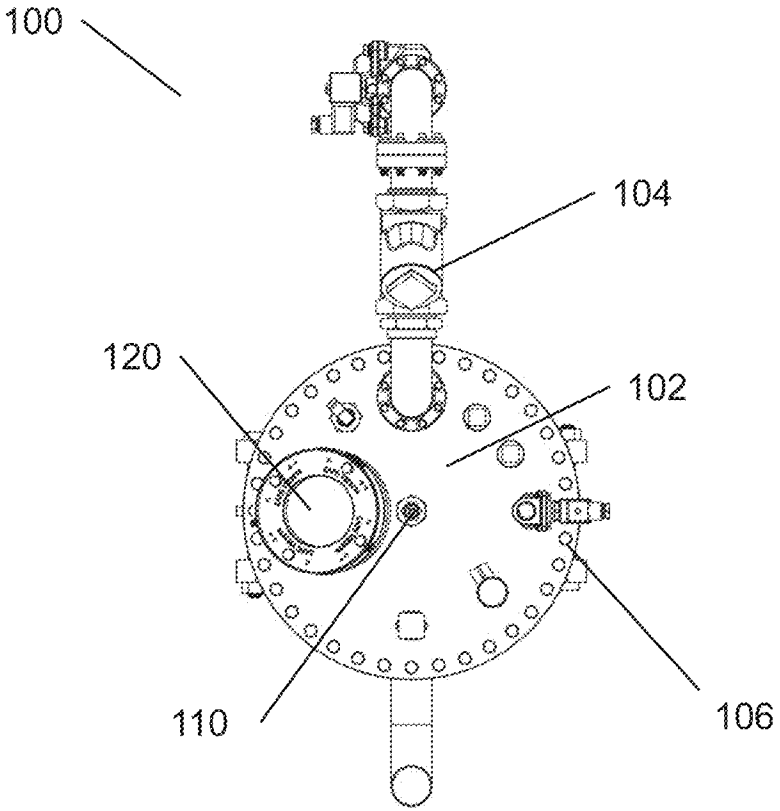
Figure 1C:
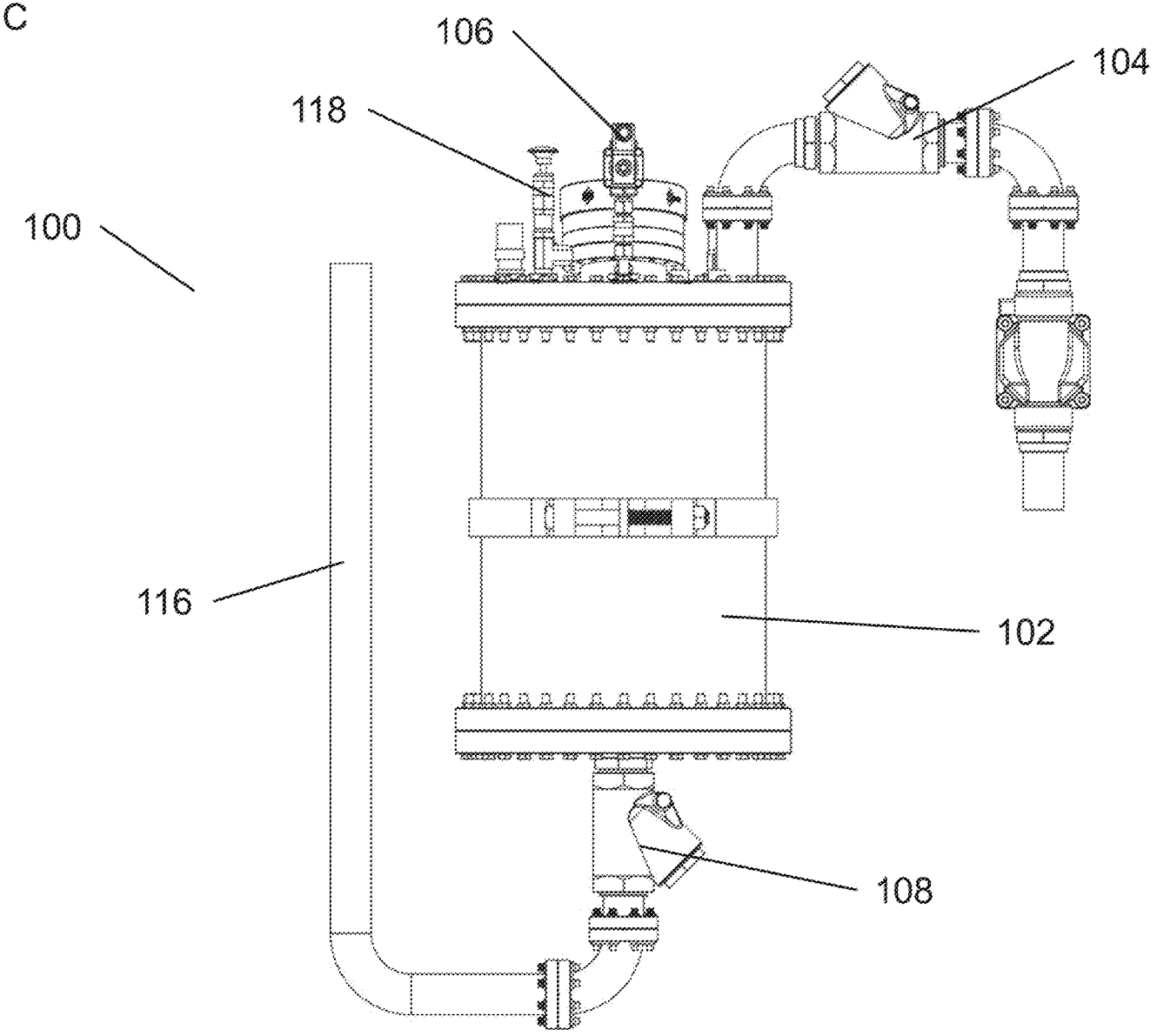
Figure 1E:
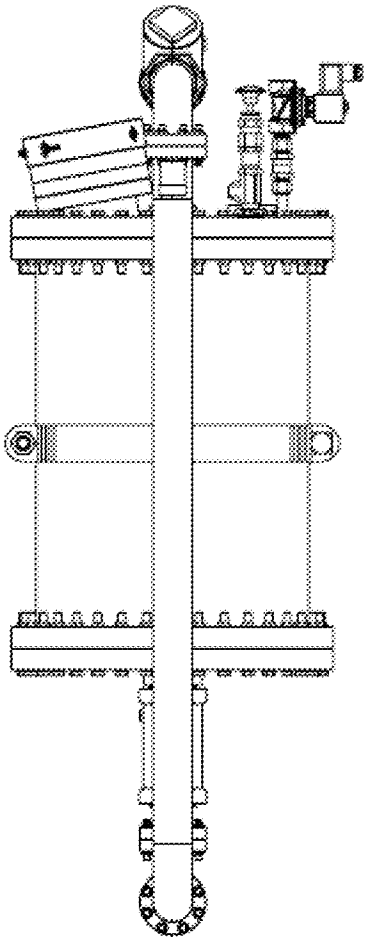
Figure 1D:
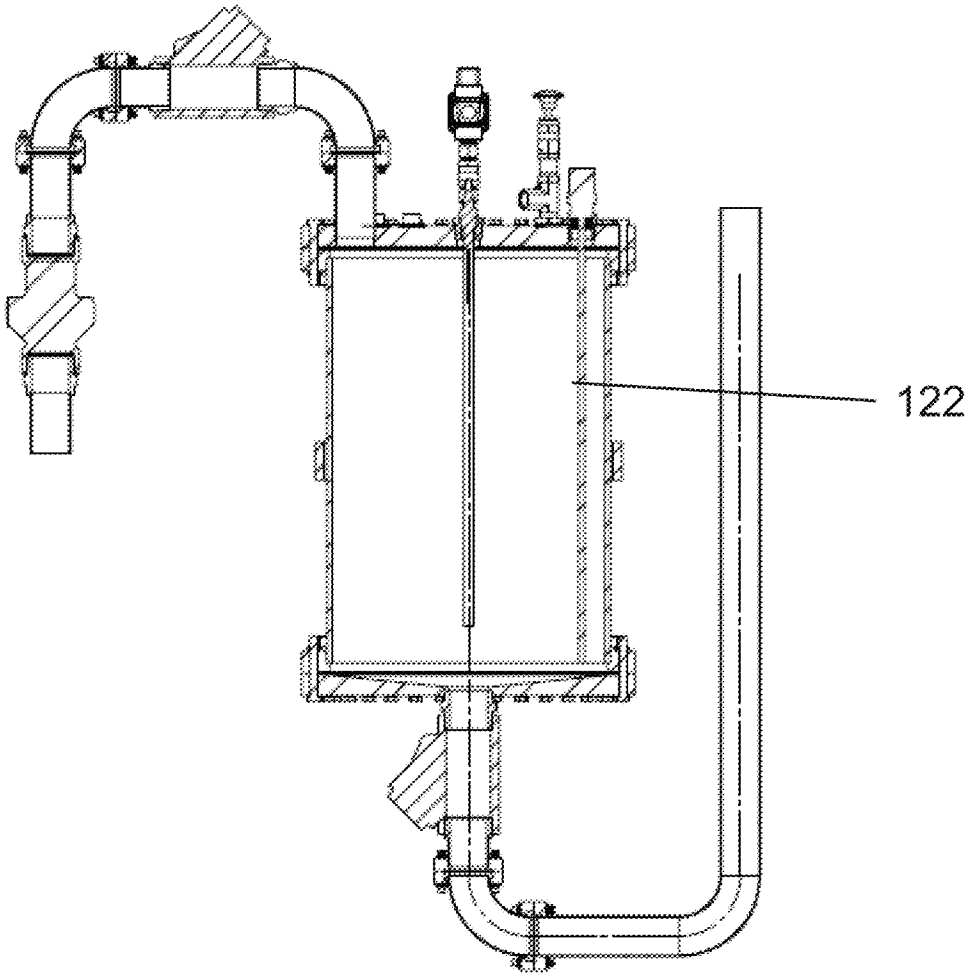

As described above, various embodiments of the pulse detonation pump can be configured in a number of ways to generate work. For example, FIGS. 1A-2C, illustrate embodiments of a pulse detonation pump configured to create work. FIGS. 1A to 1C illustrate top and side views of pump 100 with a combustion chamber 102. The combustion chamber 102 can have numerous connected elements as described above such as a gas inlet valve 106, a fluid inlet valve 104 as well as an exit or extraction valve 108. The combustion chamber 102 can also be configured with an ignition source 110. In numerous embodiments, the gas inlet valve assembly 106 can be configured to allow the flow of combustible gases (not shown) into the combustion chamber 102 such that the combustible gases would be in contact with the ignition source 110. In accordance with many embodiments, the combustible gases may be introduced into the chamber in a number of ways. For example, the combustible gases can be supplied by an external tank or supply source (not shown) and distributed into the top or bottom portion of the combustion chamber 102. In some embodiments, the gas inlet valve assembly 106 may have a supply tube 114 disposed within the tank such that the gases can be distributed to the bottom portion of the tank 102. One can appreciate that the length of the tube can vary depending on the desired point at which gases would be distributed into the tank. In some embodiments, the combustible gases may be a mixture of two or more gases that are designed to combust when in contact with an ignition source. For example, many embodiments may combine a mixture of hydrogen and oxygen gases in a desired ratio in order to produce the detonation pulse required to move or expel fluids from the chamber. It can be appreciated that any number of valves can be used as the fluid and gas inlet and outlet valves. Some embodiments may use mass flow controllers with totalizers.

The combustible gases serve as a key element in generating the necessary conditions to create the vacuum and pressure that is generally desirable for use in accordance with many embodiments. The nature of hydrogen gas is generally combustible and when combined in the appropriate stoichiometric ratio to produce $H_2O$, a hydrogen oxygen mixture is capable of producing a shockwave that can be hypersonic. Thus, such a reaction is capable of generating pressures far greater than those of current pumps.

In order to produce vacuum, the pump operates on the premise that a combustion of hydrogen and oxygen in certain stoichiometric ratios produces superheated steam as the only product. The large gas volume increase thus produced by the detonation can be allowed to expel the fluids from the combustion chamber. At the end of the expulsion only superheated steam would remain in the combustion chamber and the outlet would then be closed. The superheated steam will then be cooled by the walls of the combustion chamber and the pressure inside will drop to the vapor pressure of water at the combustion chamber temperature. For example at 29° C. the vapor pressure of $H_2O$ is 0.58 psia. Furthermore, the combustion of hydrogen and oxygen in the presence of water can improve the function of the pump. For example, when the gases are detonated by reacting with the ignition source 110 the reaction can produce a hypersonic shock wave of nearly Mach 4.5 with a potential temperature of 2800° C. nearly instantaneously. Liquid water can be introduced within the combustion chamber and act to absorb the generated heat resulting in a phase change of the water to superheated steam. As is well known, steam can serve as a mechanism to generate work. In various embodiments, the superheated steam can expand up to 2000 times its initial volume when it was liquid water and contribute to the pressure generated from the detonation to expel fluid from the chamber through the exit valve 108 and, in some embodiments, along a fluid management system 116 such as pipes. Various embodiments may utilize additional membranes to isolate the water in the combustion chamber. Such embodiments are still capable of producing the desired vacuum while realizing time and energy savings over traditional pumps.

As previously discussed, many embodiments incorporate an inlet flow valve assembly 104 and an outlet flow valve assembly 108 where each of the inlet and outlet flow valve assemblies may control the flow of a fluid into and out of the combustion chamber. In accordance with numerous embodiments, the fluid is designed to flow into and out of the chamber 102 during the process of generating vacuum and pressure within the system thereby creating a pump that can control the flow of a fluid. In some embodiments, the gas stream or gas source may come from an alternate or external source such as one or more tanks configured to combine the gases through the gas inlet valve 106 or the gases may be pre-combined. In some embodiments, the pump 100 may be configured to directly generate the supply gases through electrolysis. Accordingly, some embodiments may be configured to generate the combustible gas concentrations from the water flow itself rather than an external source.

It can be appreciated that the combustion of the gases within the combustion chamber 102 can be done in a number of ways. The ignition source 110 can be any number of suitable devices capable of causing the combustion of the gases within the chamber 102. For example, some embodiments may utilize a spark generator such as a spark plug connected to some type of electric source. Other embodiments may utilize a laser ignitor or a heated wire ignitor. In numerous embodiments, the gas introduction point can be used to dry the ignitor 110 in order to produce a more reliable ignition with each cycle. In accordance with various embodiments, the combustion chamber 102 may be configured with a pre-ignition chamber (not shown) such that the actual ignition source 110 can be isolated from the potentially damaging moisture in the chamber.

As illustrated in FIG. 1C many embodiments of the pump 100 may have an exhaust port 118 connected to the combustion chamber 102. The exhaust port may be configured to allow the remnants of the combusted gas to escape the combustion chamber without causing excessive pressure build up within the chamber 102. In some embodiments, the exhaust port 118 may be connected to the top portion of the chamber or may be positioned at any reasonable location such that it can allow the most efficient release of unwanted exhaust.

Illustrated in FIGS. 1A to 1C many embodiments may include a view port 120. A typical combustion process is generally capable of producing some type of light or plasma illumination. Such illumination may aid in the evaluation of the combustion process. Additionally, the view port 120 may be used to evaluate the status of the internal components of the combustion chamber to help improve overall maintenance and longevity of the pump 100. Numerous embodiments may also include any number of sensors 122 positioned such that they can monitor pressure, velocity, temperature, water level, and any other internal conditions of the combustion chamber 102 during the functioning of the pump. It can be appreciated that any number of sensors at different locations within and external to the combustion chamber 102 for monitoring the process may be installed. Additionally, some embodiments may utilize a variety of different types of sensors to enable the most accurate control of the fluids entering and exiting the chamber. For example, some embodiments may use mass flow controllers and/or accumulators to measure the gas charge in the combustion chamber.

Figure 2A:
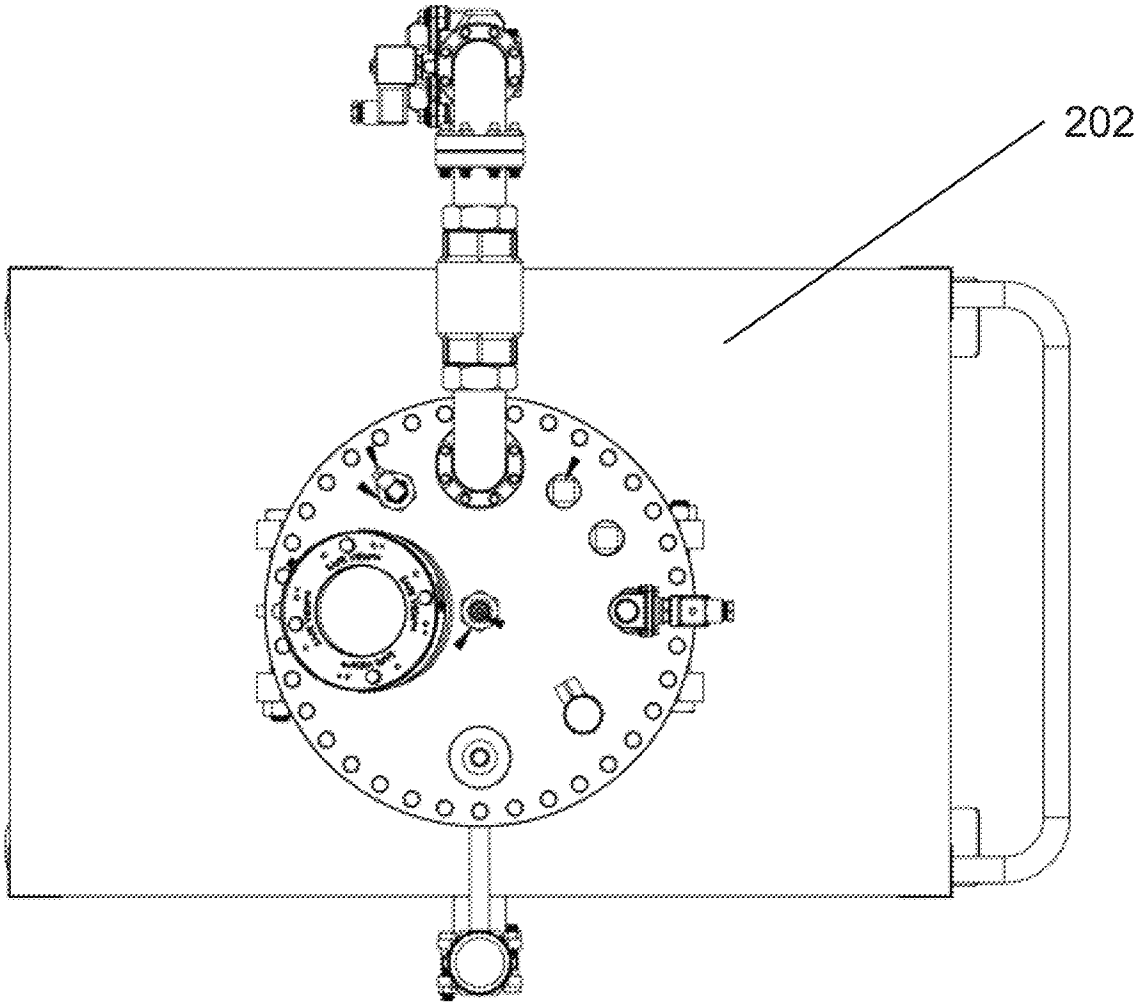
FIGS. 2A-2C illustrate alternate views of a mobile pulse detonation pump in accordance with embodiments of the invention.
Figure 2C:
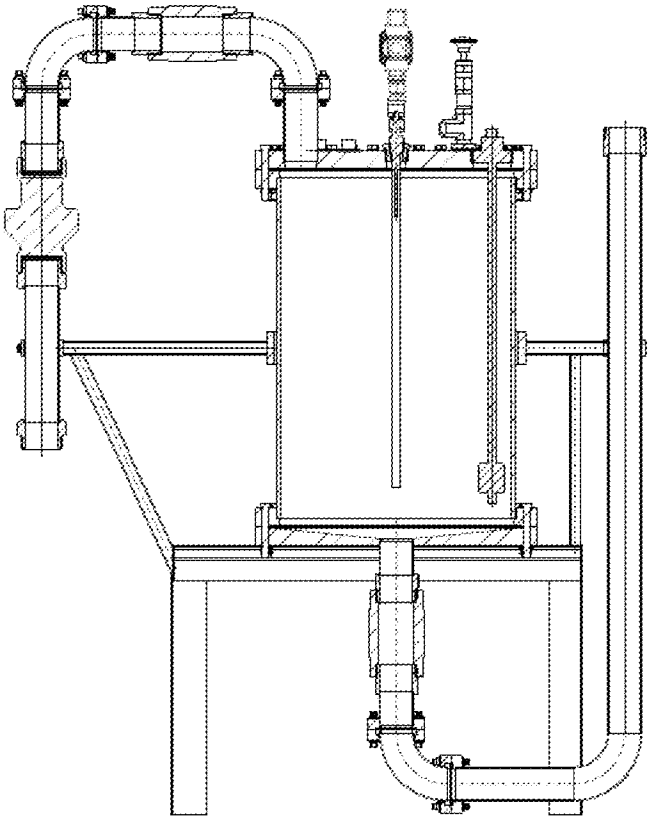
Figure 2B:
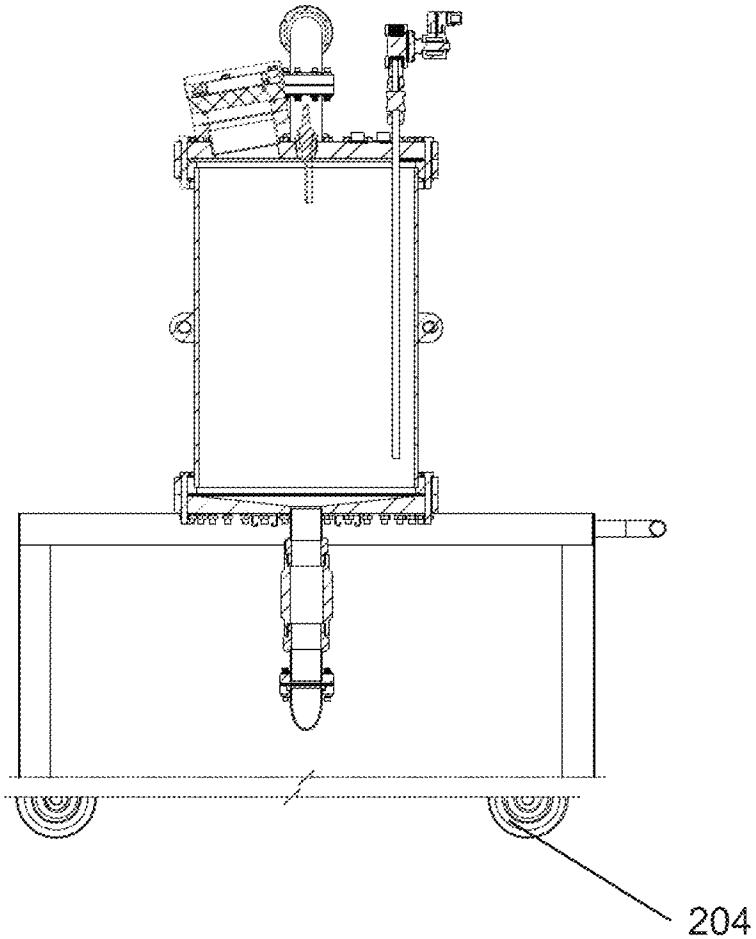

Turning now to FIGS. 2A-2C, other embodiments of the pump are illustrated. A feature of many of the embodiments is not only the functionality and reliability of the pump but the portability of some embodiments. For example, FIG. 2A illustrates a top view of a pump 200 that is stationed on a mobile cart 202. The cart 202 in accordance with some embodiments may be outfitted with several wheels 204 such that the pump may be moved from one location to another. Such embodiments illustrate the scalability of the pump for a variety of applications. For example, the pump may be used as a refrigerant cooling pump. Additionally, the mobility of the pump may allow the pump to serve as a vacuum type tool or pressure tool in a variety of applications such as applying vacuum during an elevated temperature cure cycle.

Figure 3:
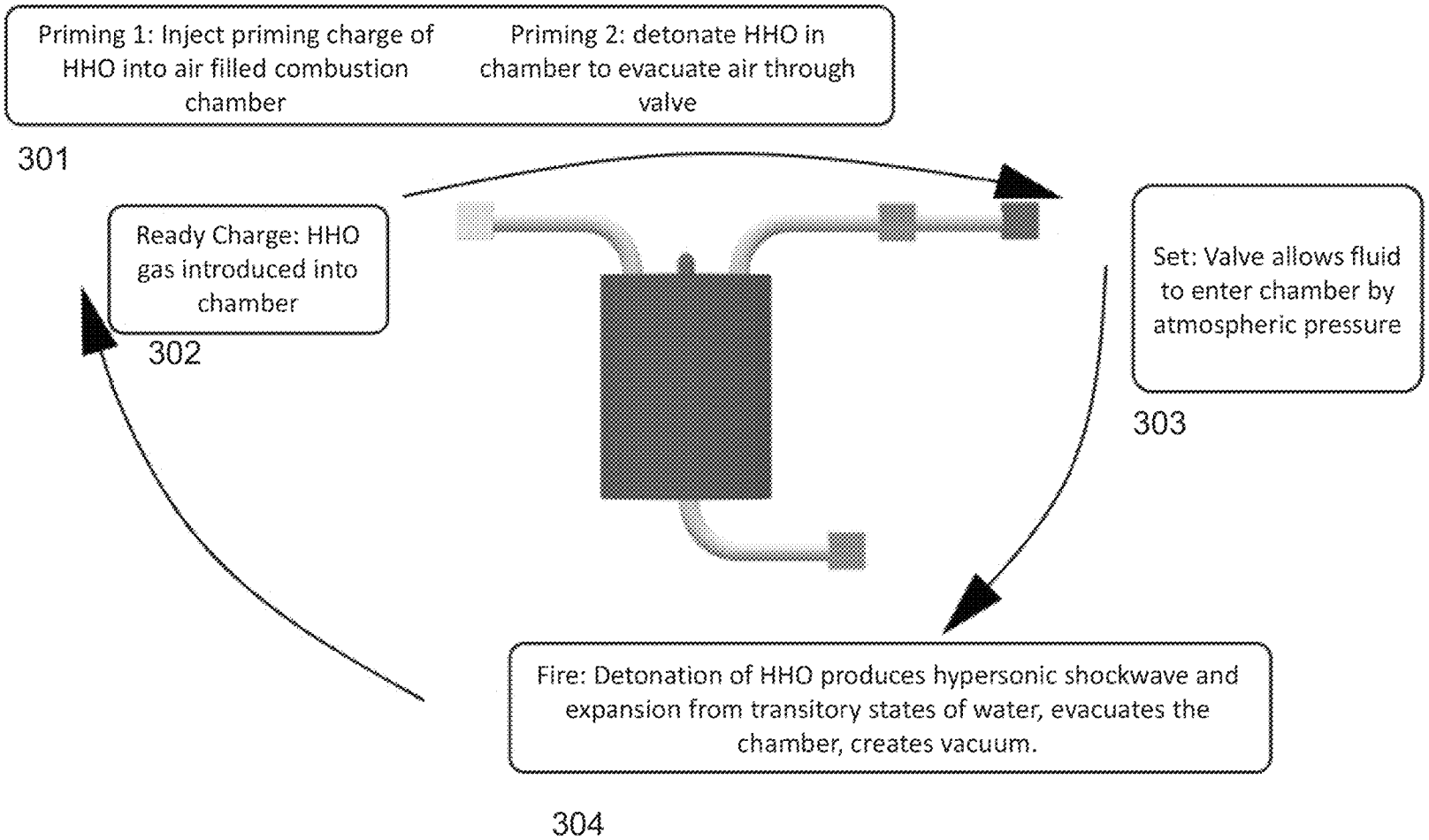
FIG. 3 illustrates the progressive cyclic stages of a pulse detonation pump in accordance with embodiments of the invention.

As can be appreciated, many embodiments of the pump can operate in a cyclic fashion as do many traditional pumps. However, as has been discussed throughout, the method of operation of numerous embodiments is fundamentally different from pumps currently belonging to the state of the art. Accordingly, FIG. 3 illustrates a pulse detonation pump cycle in various phases in accordance with embodiments. FIG. 3 illustrates an embodiment of a pump 300 that is primed 301 in order to obtain the desired operational vacuum. The cycle is then commenced by allowing fluid into the combustion chamber 302. Then oxyhydrogen gas is introduced into the chamber 303. The oxyhydrogen gas is ignited 304. The detonation of the oxyhydrogen gas produces a hypersonic shockwave that ejects the fluid from the combustion chamber. The ejection of the fluid results in a reduction of the pressure inside the combustion chamber to well below atmospheric pressure. For example, demonstrations of the apparatus have shown this ejection and subsequent reduction of pressure occurs in less than one second. The cycle is repeated by returning to 302. Furthermore, many embodiments, as discussed above result in a portion of the fluid being heated to superheated steam further capable of producing work to help move fluid out of the chamber.

Figure 4:
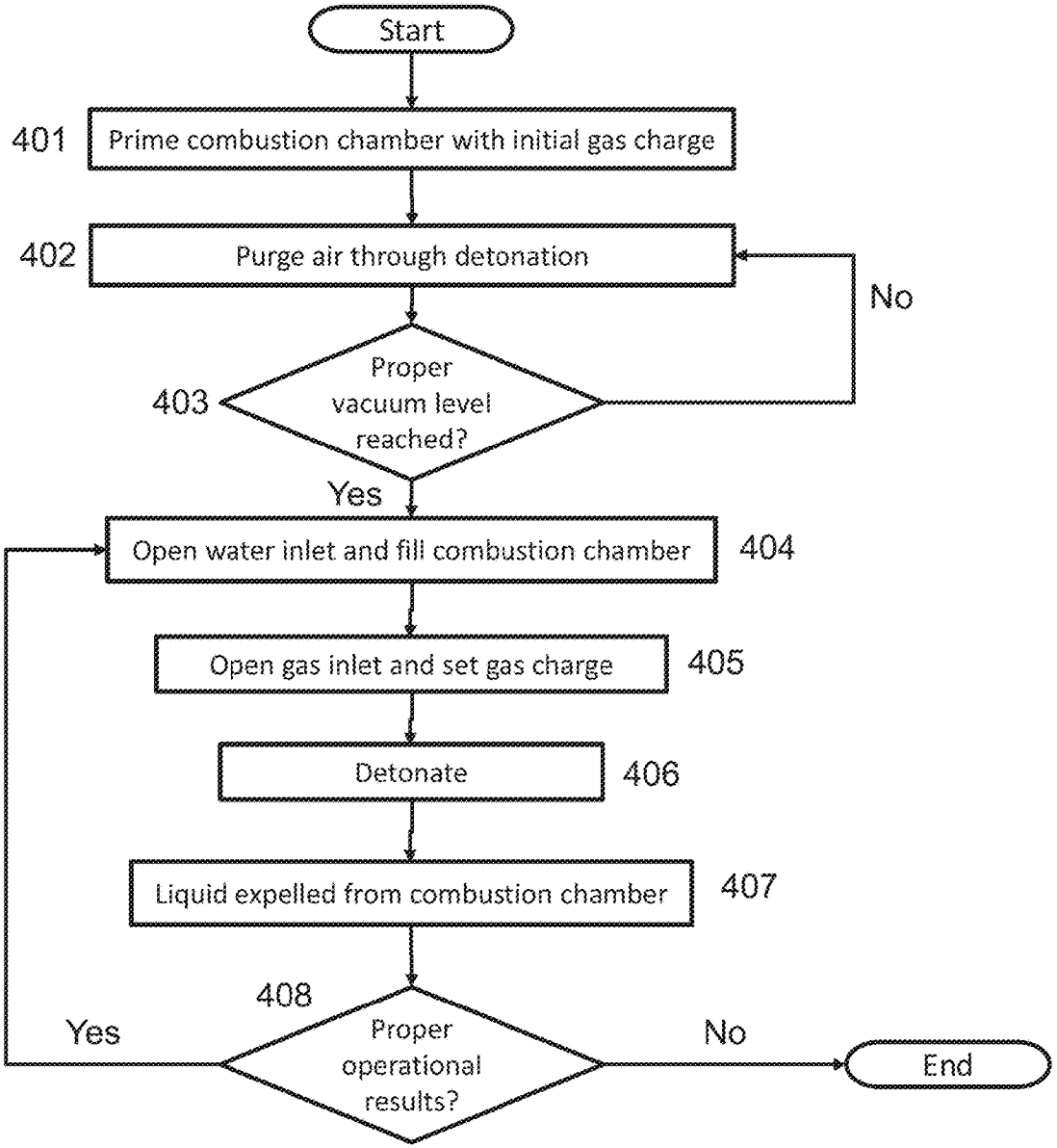
FIG. 4 illustrates a flow diagram of a pulse detonation pump process in accordance with embodiments of the invention.

FIG. 4 illustrates a process flow diagram of a combustion cycle in accordance with numerous embodiments. For example, the combustion chamber can be primed 401 with an initial gas load that can subsequently be detonated 402 to purge the chamber. Once the initial priming (401 and 402) has been completed and proper vacuum has been determined and reached 403, the pump cycle can begin. This cycle consists of the following: open water inlet and fill combustion chamber 404, open gas inlet and set gas charge 405, detonate 406, expel fluid from combustion chamber 407, verify operational results 408, repeat cycle or end process.

Figure 5A:
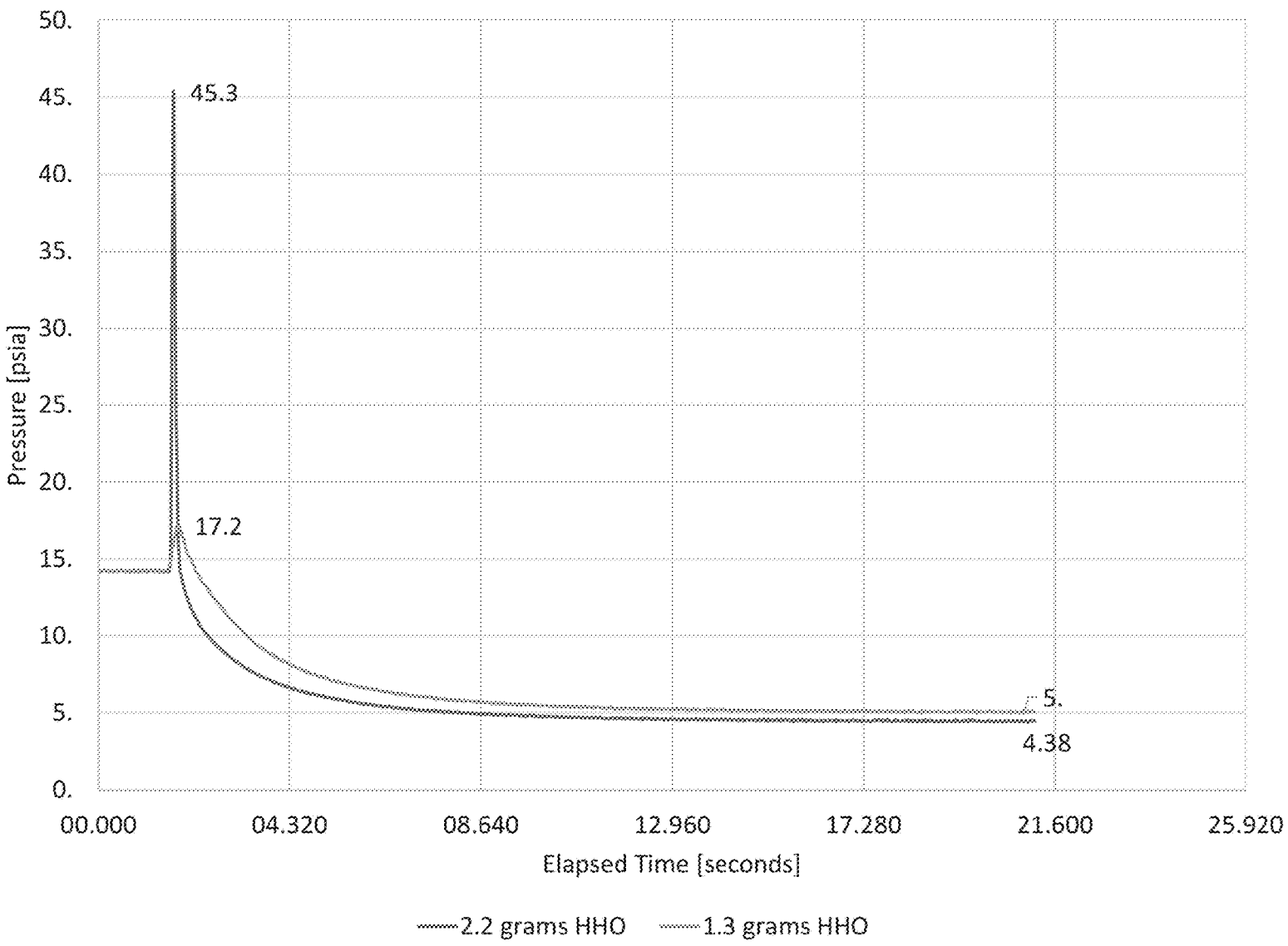
FIGS. 5A-5C graphically illustrate pressures reached in sample runs in accordance with embodiments of the invention.
Figure 5B:
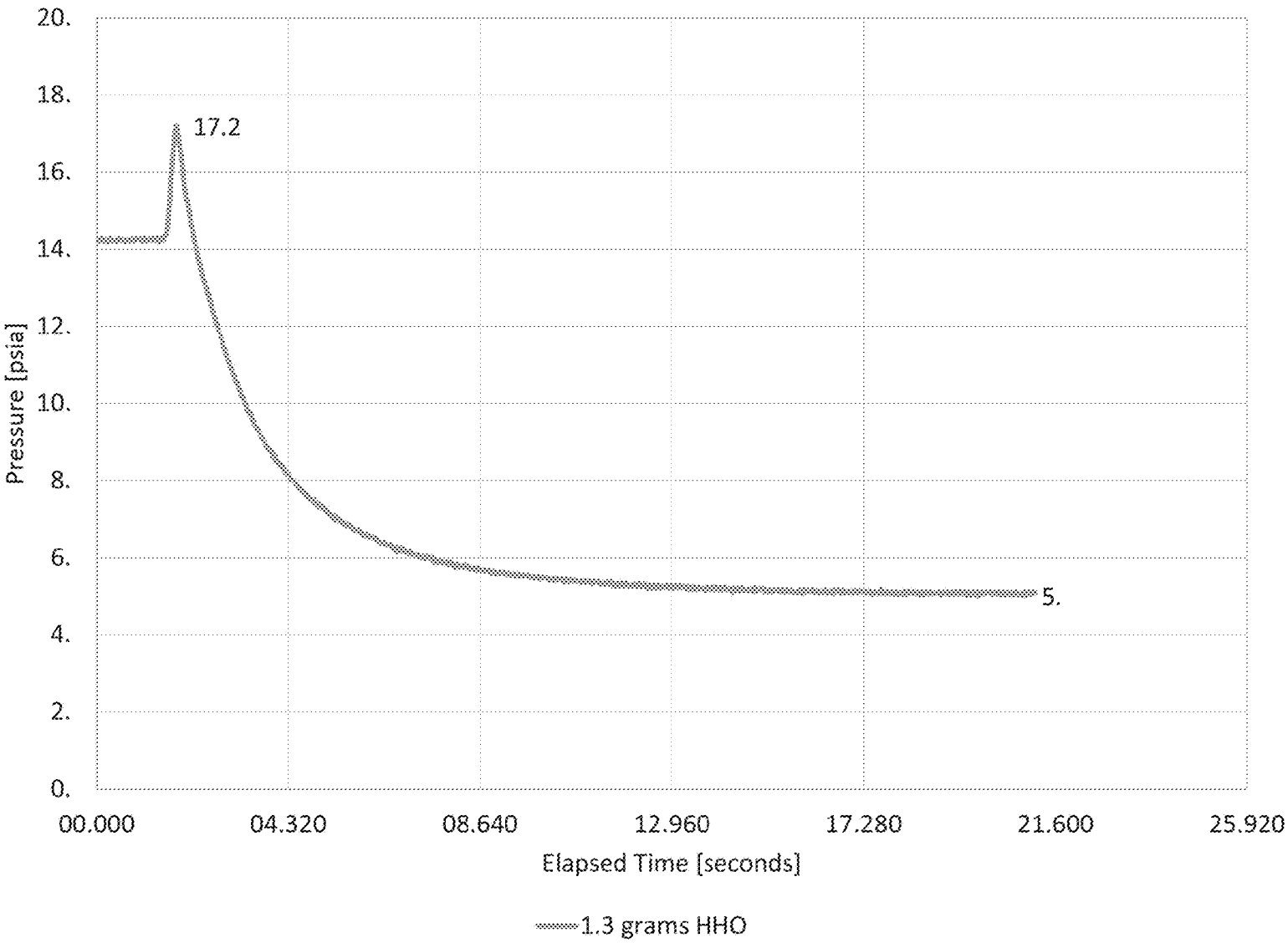
Figure 5C:
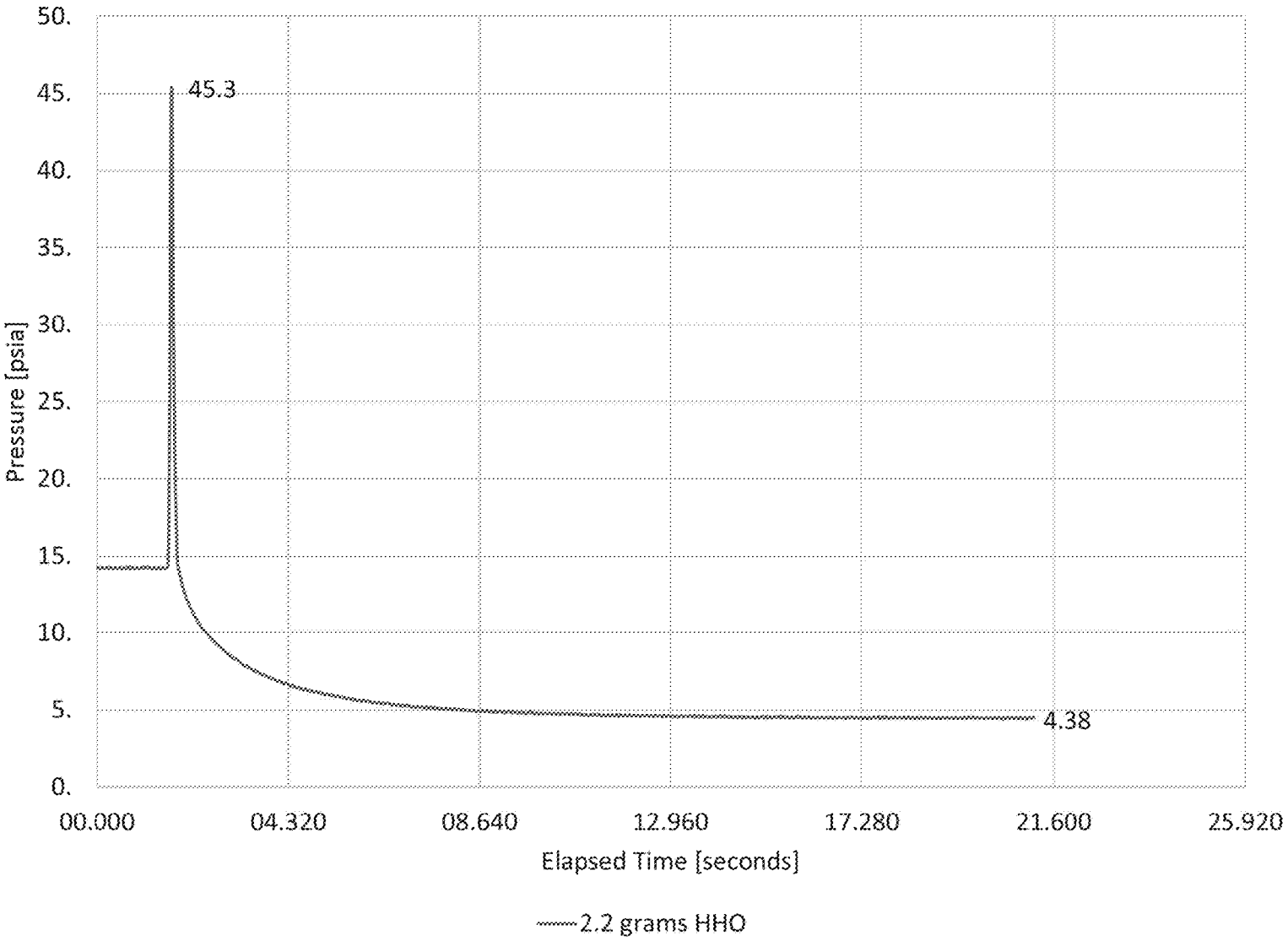

Many embodiments are directed to a pump that operates on the premise of the combustion of a mixture of hydrogen gas with oxygen gas that upon combustion, generates a hypersonic pulse detonation shockwave which results in the near instantaneous transfer of energy to water acting as a flexible piston. In numerous embodiments, the combustion reaction is also capable of producing high temperature, high pressure superheated steam. The subsequent implosion of the gas component along with the condensation of the superheated steam can subsequently generate a vacuum within the chamber that is much lower than the external ambient pressure. The pressure differential between the shockwave, high pressure superheated steam, the condensed fluid, and the ambient external pressure allows for many embodiments to produce work. In some embodiments the work may be illustrated as a pressurizing pump, while other embodiments may translate the work in the form of a vacuum pump. The capabilities of numerous embodiments discussed herein can be illustrated by the graphs in FIGS. 5A-5C which show actual pressure-time plots resulting from multiple detonations in the apparatus depicted in FIG. 1A-1E. FIG. 5A shows two detonations plotted on the same graph so the differences in the pressure results from the detonations can be clearly seen. The initial conditions in the apparatus only differed in the amount of oxyhydrogen utilized. The detonation illustrated in FIG. 5B had 1.3 grams of oxyhydrogen whereas the detonation illustrated in FIG. 5C, with the larger range, had 2.2 grams of oxyhydrogen. The 40 liter combustion chamber in each case contained 22 liters of water and 18 liters of air. The temperature was 22° C. and the atmospheric pressure was 14.4 psia. For 1.3 grams of oxyhydrogen, FIG. 5B shows that the pressure increases to a maximum of 17.2 psia in 0.29 seconds returning to atmospheric pressure 0.40 seconds later. The pressure decreases asymptotically to a limit of 5.00 psia reaching 50% of the limiting low pressure by 3.45 seconds. For 2.2 grams of oxyhydrogen, FIG. 5C shows the that the pressure increases to a maximum of 45.3 psia in 0.095 seconds returning to atmospheric pressure 0.14 seconds later. The pressure decreases asymptotically to a limit of 4.38 psia reaching 50% of the limiting low pressure by 2.65 seconds. The faster and more complete expulsion of the fluid in the combustion chamber by the larger charge of oxyhydrogen shows the utility of this approach.

Applications of the Pump

As previously described, the embodiments of the pump can be used in a variety of different applications. Some embodiments may include, but not be limited to, generating vacuum (as previously described), refrigeration or air conditioning, cooling water, distilling water, pumping water or other fluids, geological fracturing, providing a cooling mechanism for nuclear reactors, and/or use as a rotary detonation engine. Additionally, many embodiments may include the use of two or more pumps to operate independently, in tandem cells, synchronously and asynchronously to perform the desired functions of the overall system.

Some embodiments may include a method for using the pump in a manner that could perform geological fracturing. For example, in some embodiments, the pump may be sized to provide any working pressure the system is designed to contain. This may be done with the gases set at standard atmosphere or under compression. Accordingly, embodiments of a pump could incorporate multiple cells that can be programmed to support the hypersonic shockwave to serve this purpose. Embodiments of the pump could be fitted to the well cap rather than to standby truck beds as is currently standard operating procedure. This allows for higher pressures and improved blow out safety.

Figure 6:
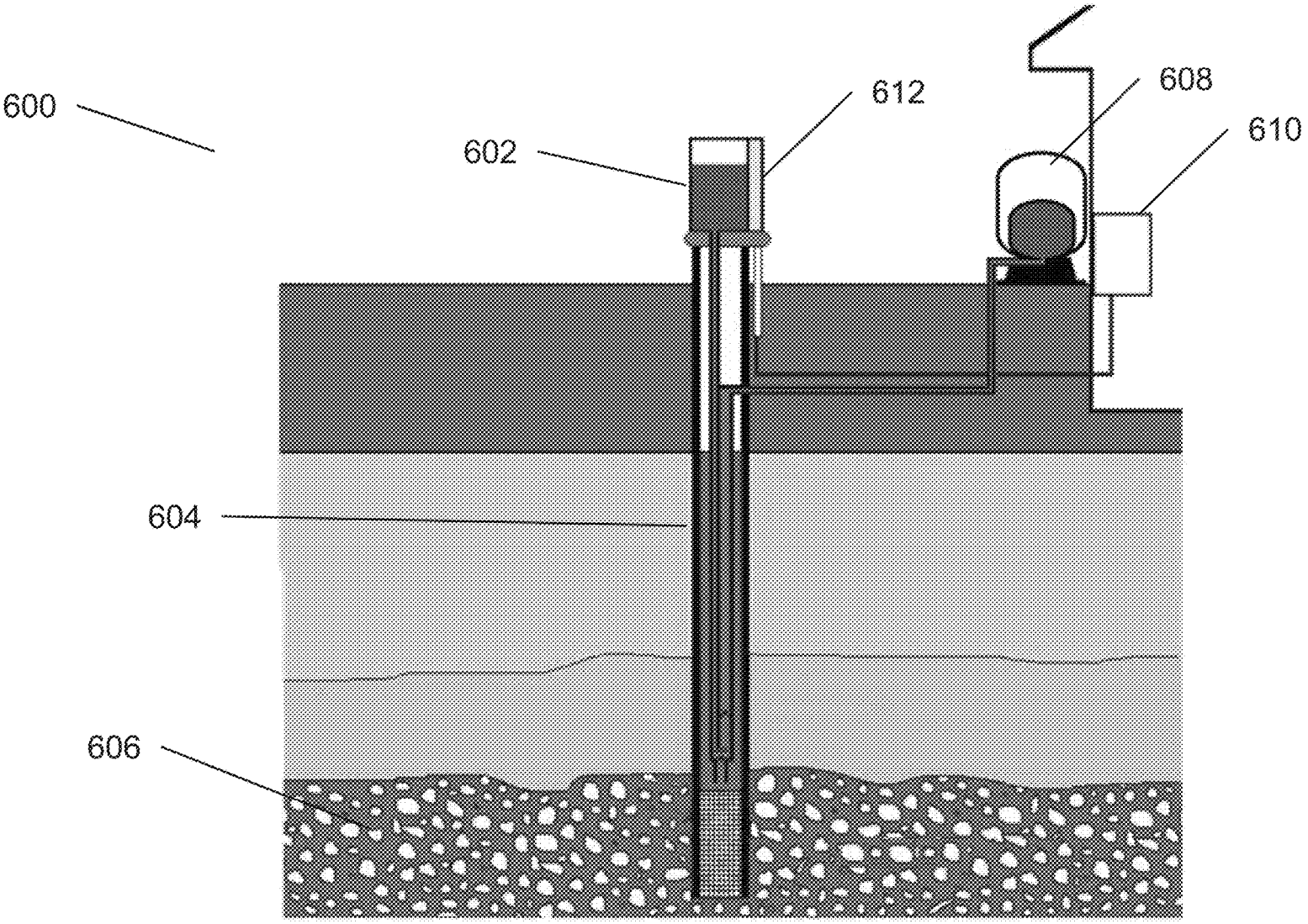
FIG. 6 illustrates a pulse detonation water pump system in accordance with embodiments of the invention.

Other embodiments of the pump may be designed to transport or pump water to any number of locations for any number of uses. For example, FIG. 6 illustrates a pulse detonation pump system 600 in accordance with embodiments described herein configured to pump water. The pump 602 may be used in conjunction with piping 604 that is in fluid communication with an aquifer 606. Accordingly, the detonation cycle of the pump and subsequent generation of vacuum can act to draw water from the aquifer 606 into the pump and subsequently into an external tank 608. Accordingly, the detonation cycle of the pump provides the desired pressure and velocity to feed a venturi style pump below the water line of aquifer 606 and raise it into the external tank 608. In accordance with various embodiments, the pump system 600 may also have external power sources 610 as well as electronic control units 612 electronically connected to the power source 610, where the electronic control units can operate to control the amount of gases put into the combustion chamber as well as the subsequent ignition of the gases. Additionally, many embodiments may utilize the control unit 612 to alter or adjust the flow of both liquid and gas based on the changing environmental conditions such as air pressure and/or water levels. Furthermore, some embodiments may incorporate an electrolysis control system embedded within the control unit that, in accordance with embodiments, can act to generate additional combustible gases from the supplied water. Although various embodiments may operate to extract fluid, such as water, in some embodiments the pump 602 can be used to extract steam from a well to have its state changed back to liquid. It can be appreciated that many such pump applications can be modified with larger or smaller diameter pipes based on the overall desired nature and/or pressures if needed from the pump. Although electrical power requirements may be supplied by a number of methods, in numerous embodiments, the pump may be designed to utilize telluric current in order to accomplish electrolysis.

Figure 7:
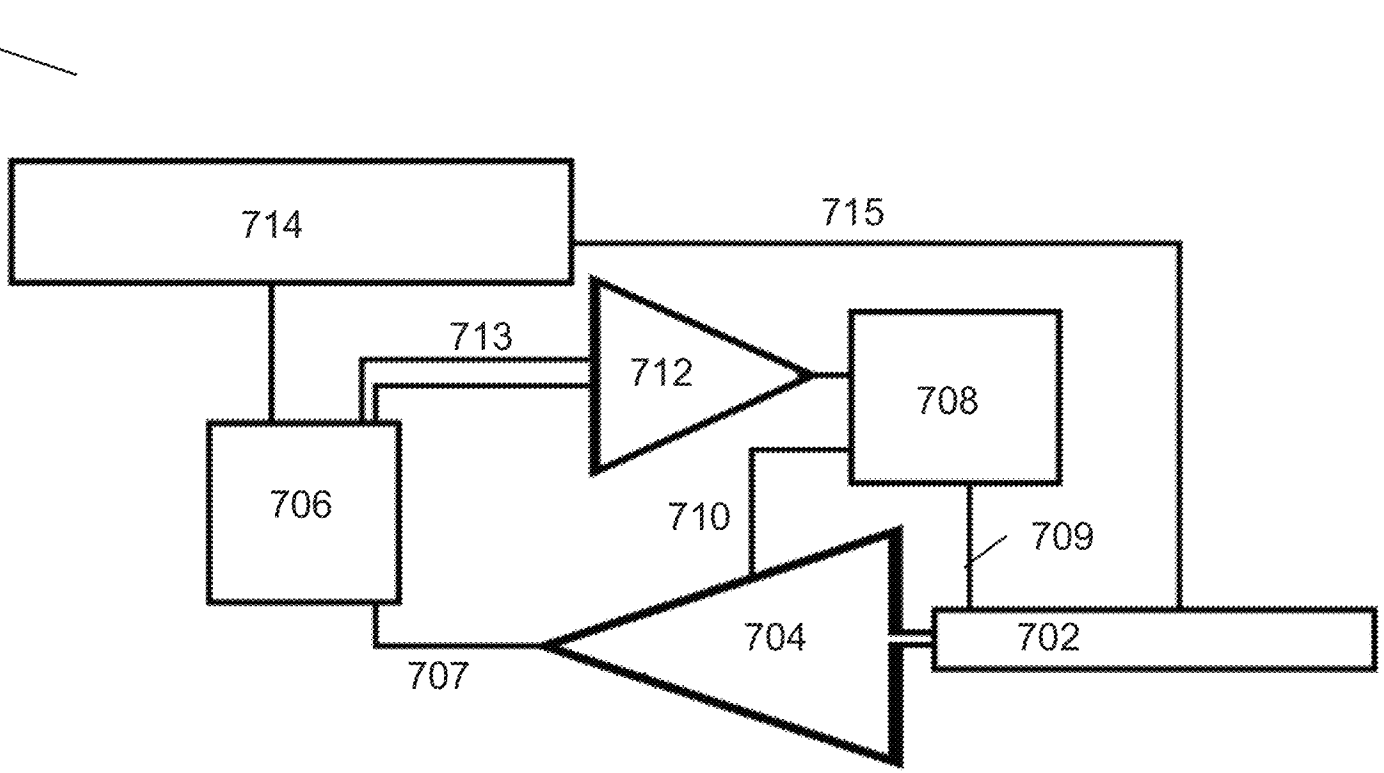
FIG. 7 illustrates a steam cycle in accordance with embodiments of the invention.

FIG. 7 further illustrates the use of a pulse detonation pump within a steam production cycle/system 700. For example, the steam system 700 may be configured with a pulse detonation pump 702, in accordance with embodiments described herein where the pump 702 is connected to a steam recompressor 704. The steam recompressor 704 is configured to repressurize the steam and direct it back into a boiler 706 via a repressurized steam line 707 such that the boiler can be "topped off" for reuse. Additionally the pulse detonation pump 702 can be connected to a vacuum dump 708 by a high vacuum line 709 that can be used as a moderator to the cycle 700 and is cycled in and out of the circuit. Various embodiments may also include a turbine 712 to depressurize the steam input 713 from the boiler 706. In some embodiments, the boiler 706 can be connected to and feed a hydrogen source 714 which can be used to generate and supply 715 the gases for the pulse detonation pump 702. Accordingly, it can be appreciated that embodiments of the pulse detonation pump 702 can be configured to generate steam and be applied to various steam systems in order to generate work such as moving a turbine engine for generating electricity.

Other applications of the pumps and pump cells in accordance with many embodiments may be used to generate vacuum for a variety of applications. For example, the pumps may be configured to distill water. The vacuum levels allow for the low-pressure flash distillation of any substance such as seawater and/or sewage from which distilled water needs to be extracted. Flash distillation and fluid transport can both be achieved within the same energy footprint. Some embodiments of the pump may incorporate multiple cells or pumps that operate to produce flash distillation of water. An example may be where one pump is positioned at a water source such as the sea. The first pump may be used to generate steam during the combustion process. The steam may then be supplied to a second pump that repressurizes the steam generating water that may be pumped to some alternate location.

As previously mentioned some embodiments of the pump may be used in various types of HVAC systems. The vacuum and pressure generated can be directly utilized in vacuum refrigeration and other steam ejector based systems.

Figure 8A:
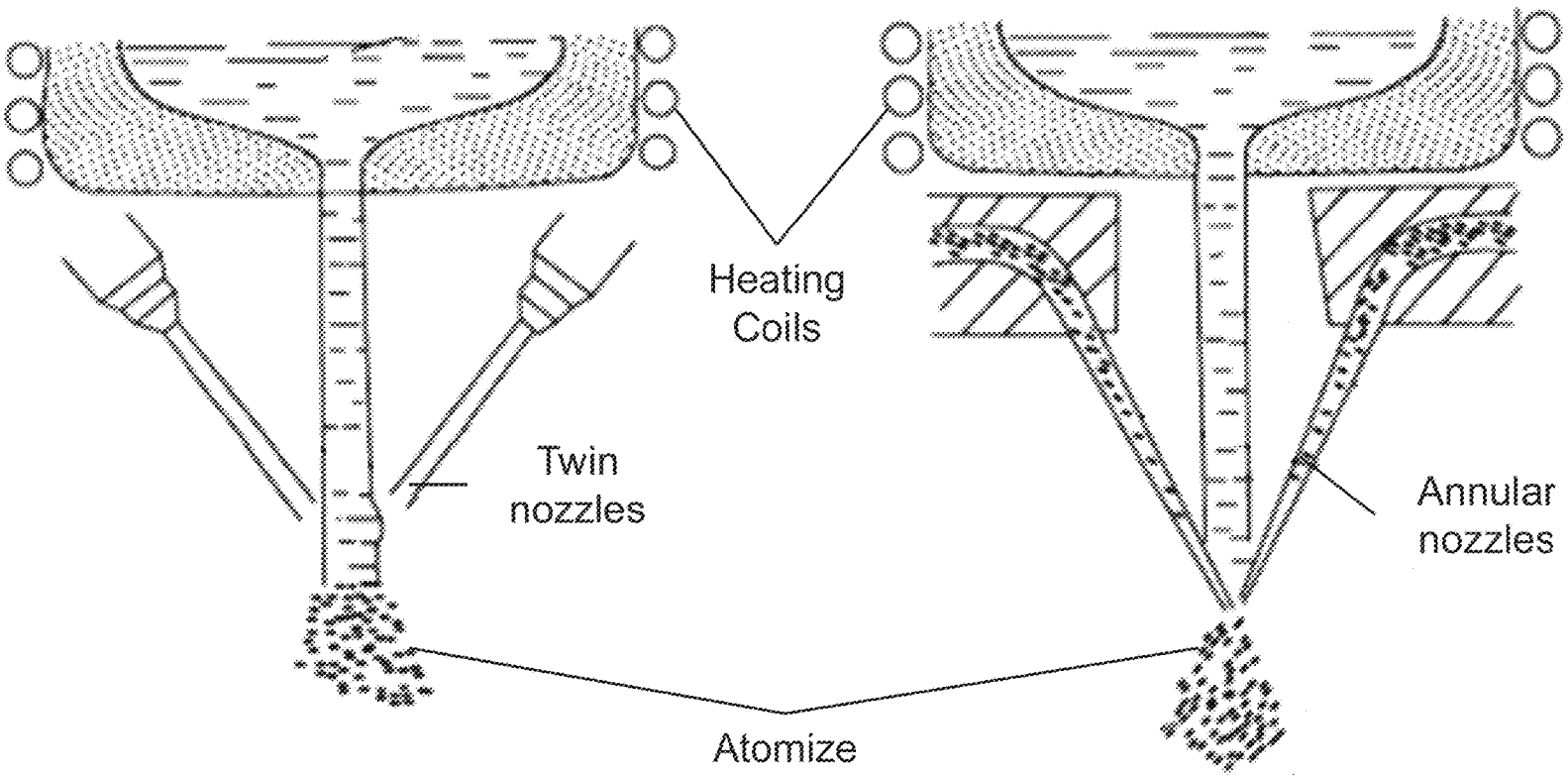
Prior Art FIG. 8A
FIGS. 8A and 8B illustrate atomization processes in accordance with what is known in the art.
Figure 8B:
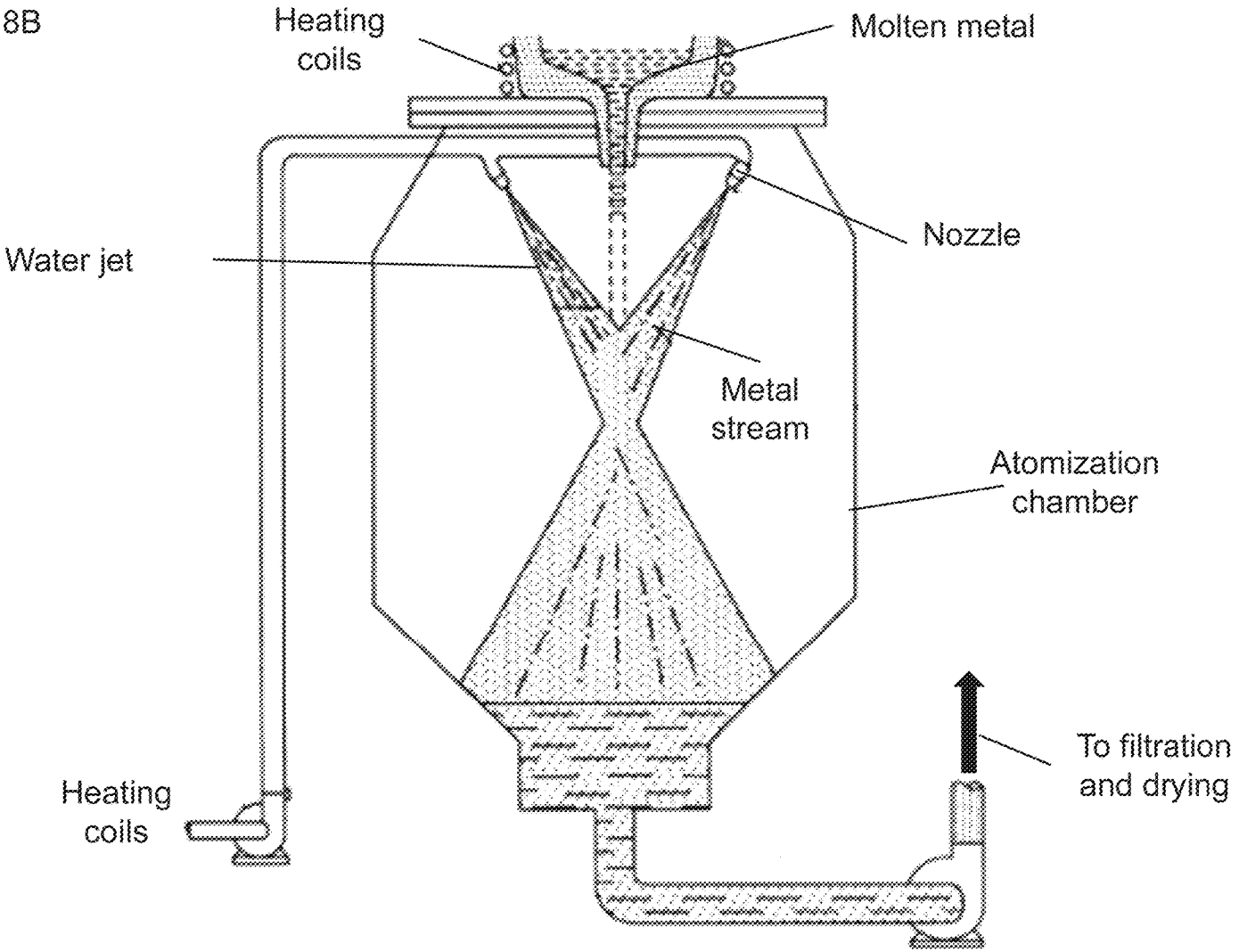
FIG. 8B Prior Art

In accordance with many embodiments, the pump may be used to perform metallic atomization for the production of metal powders of finer size and a more uniform shape than is currently achievable. These metal powders can be used in applications like permanent magnets with strong magnetic field alignments. Atomization, typically occurs by a gravity fed molten metal passing through an orifice and exposing the molten metal to differing high pressure high velocity streams of air, oil, or water producing turbulence, thus atomizing the metallic particles into the desired fineness. For example, FIGS. 8A and 8B illustrate air and water atomization processes in accordance with known methods in the art. The desired goal is to produce particles of a uniform fineness and sphericity. One issue commonly seen with such known methods is that the finer the desired particulate the more likely the particles cool prematurely and form random shapes resulting in an undesirable product.

Figure 9:
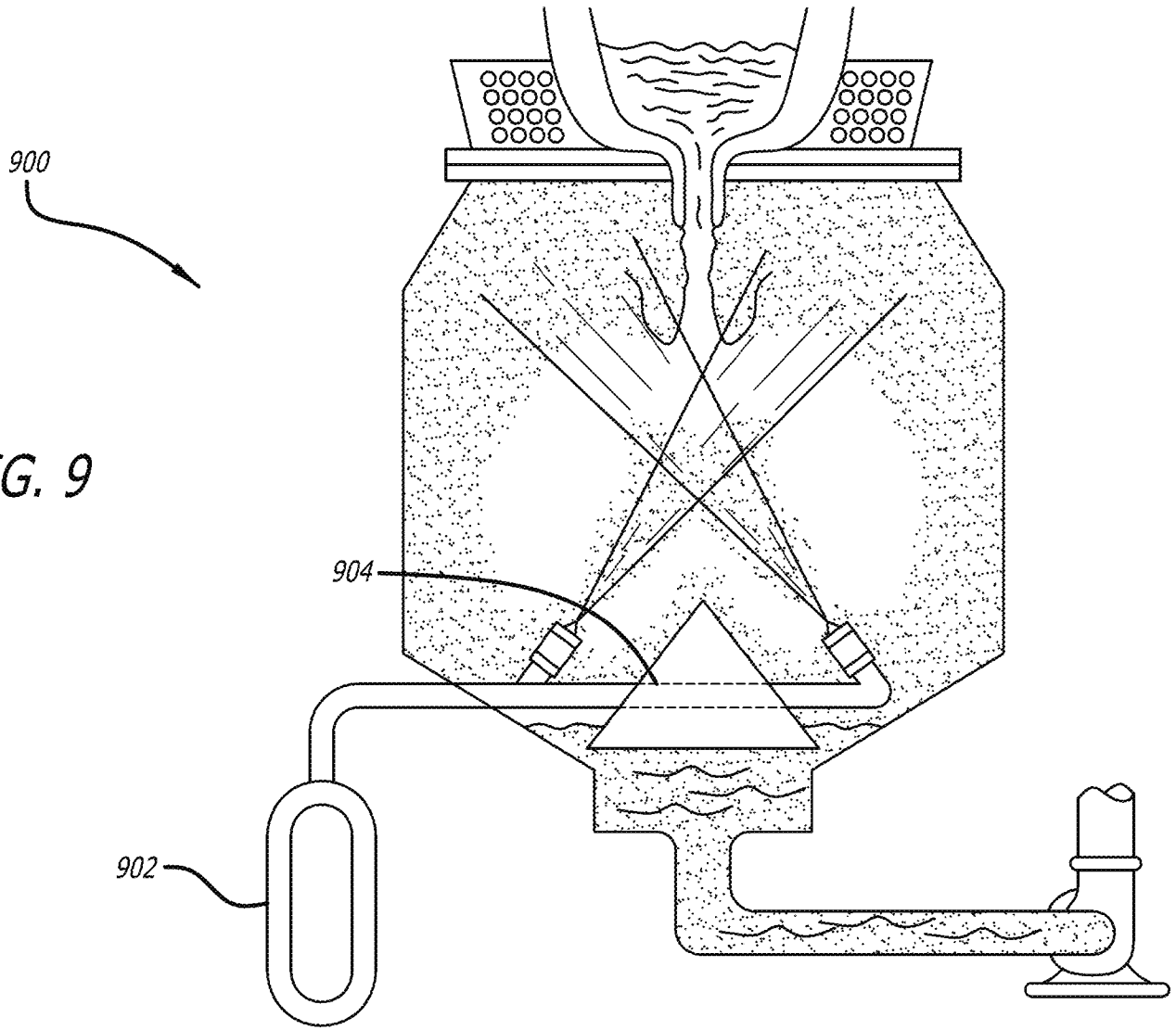
FIG. 9 illustrates atomization processes in accordance with embodiments of the invention.

In contrast, many embodiments of the present invention may be utilized as shown in FIG. 9 to perform atomization by the use of a hypersonic blast that occurs with the ignition of the gaseous mixture within a chamber. For example, in some embodiments an atomization system 900 can be configured with a pulse detonation pump 902 that is optimized to generate a hypersonic blast that can be translated to molten metal 904. Accordingly, the hypersonic blast can vaporize a molten metal 904 into sub-micron particles by blasting the stream of molten metal with high velocity superheated steam created by pulse detonation of the proper oxyhydrogen mix to establish a reducing atmosphere. Current research shows the key to finer size is the velocity used to blast the molten metal. Additionally, in accordance with many embodiments, the presence of magnetic fields may aid to align and degauss the particles. Accordingly, many such embodiments, would allow for a very uniform way of creating amorphous steel and other rare earth particles polarized or degaussed to make stronger materials or desired magnetic field alignments. In some embodiments, a revised metal powder furnace could utilize a pulse detonation pump in conjunction with natural gravity forces to provide a longer gravitational hang time to achieve a uniform spherical form within an atomization process.

As described previously, some embodiments of a pulse detonation pump could be applied in a rotary detonation pump design which can have numerous applications including, but not limited to aerospace. For example, various embodiments of a rotary detonation pump can operate as a rotary detonation engine and/or aerospike engine combustor which will allow for water injection at key locations to manage temperature and benefit the combustion thrust stream by the rapid expansion of the water to accelerated superheated steam at hypersonic speed. In linear aerospike engines the injection of water at the initial point in which combustion products encounter the ramp, will shield the ramp from excessive temperatures by the rapidly expanding superheated steam. This expansion, along with shielding the ramp from excessive thermal load, can be controlled in varying degree by the volume of water delivery. This added steam component will also serve to increase the density of the ejected mass. This may improve the engines acceleration. In aerospike engines with variable length nozzle designs water can also be introduced at this point. In accordance with many embodiments, a pulse detonation pump can be used in the injection of water at critical points for rotary detonation and aerospike engines to enhance cooling and improve function. This is not to exclude linear designs, but the rotary detonation model applied to development of combustor arrays will also have its application as an enclosed pump to develop pressures and vacuums for fuels and oxidizers and aerospace engine combustors.

Figure 10:
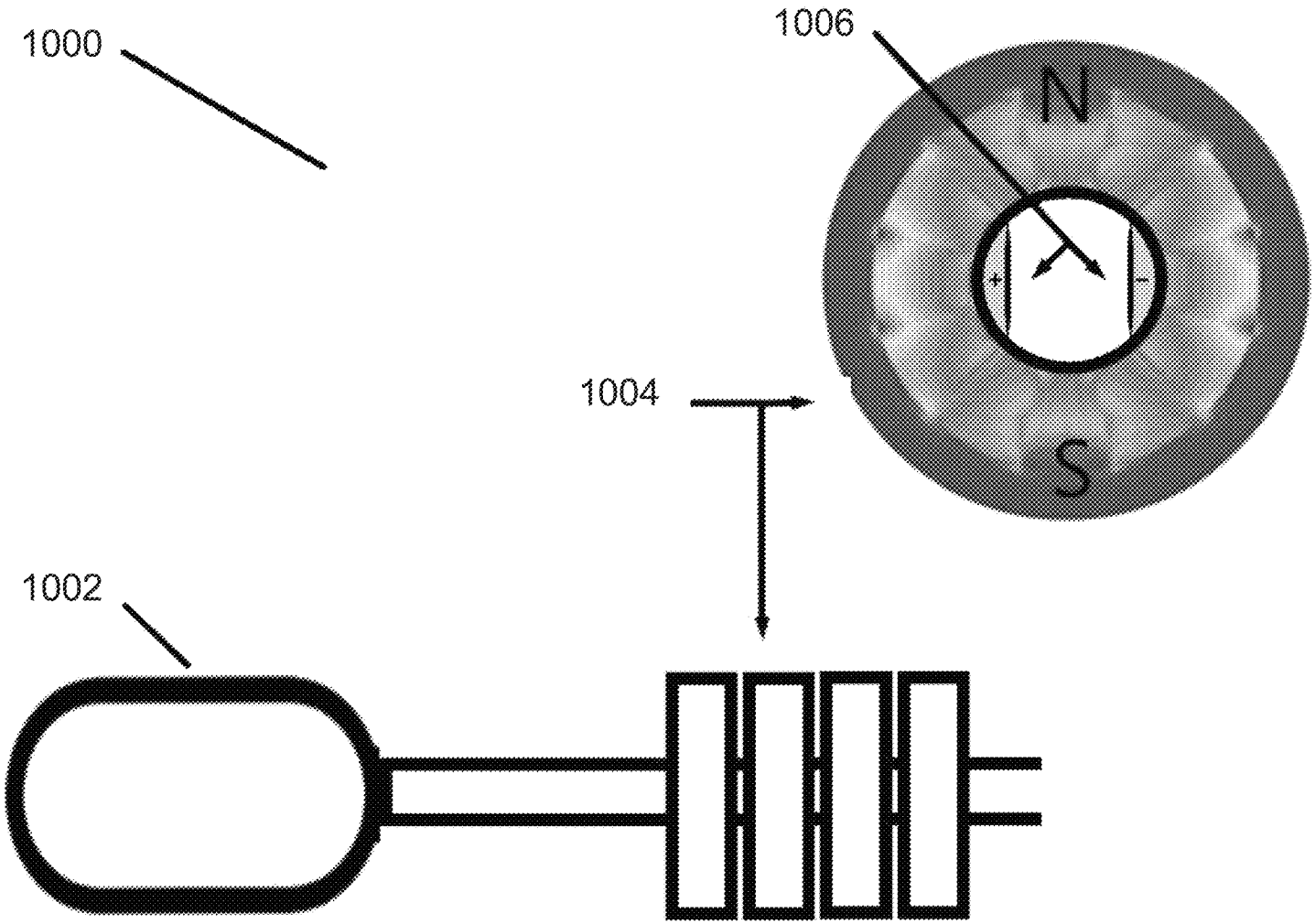
FIG. 10 illustrates a magneto-hydrodynamic generator/thruster in accordance with embodiments of the invention.

In accordance with some embodiments the pulse detonation water pump can be adapted to a magneto-hydrodynamic generator/thruster. The magneto-hydrodynamic generator/thruster utilizes electrodes placed in a strong magnetic field. For use as a generator, motion of a conductive fluid through the device creates an electric current which can be collected from the electrodes. For use as a thruster, application of voltage between the electrodes accelerates the fluid. For example, FIG. 10 illustrates a magneto-hydrodynamic generator/thruster system 1000 that utilizes a pulse detonation pump 1002. The magnetic field required can be generated by a Halbach array 1004. A Halbach array is a precise arrangement of permanent magnets that directs the magnetic field in a specific desired area. The electrodes 1006 in the magnetic field are shown installed in a tube passing through the Halbach magnetic array. Current magneto-hydrodynamic thruster technology is less effective at lower velocities which is overcome by the high velocities generated by the pulse detonation pump. In various embodiments, a pulse detonation pump can be utilized to accelerate conductive fluids which will generate a current across electrodes 1006 in order to produce power.

Figure 11:
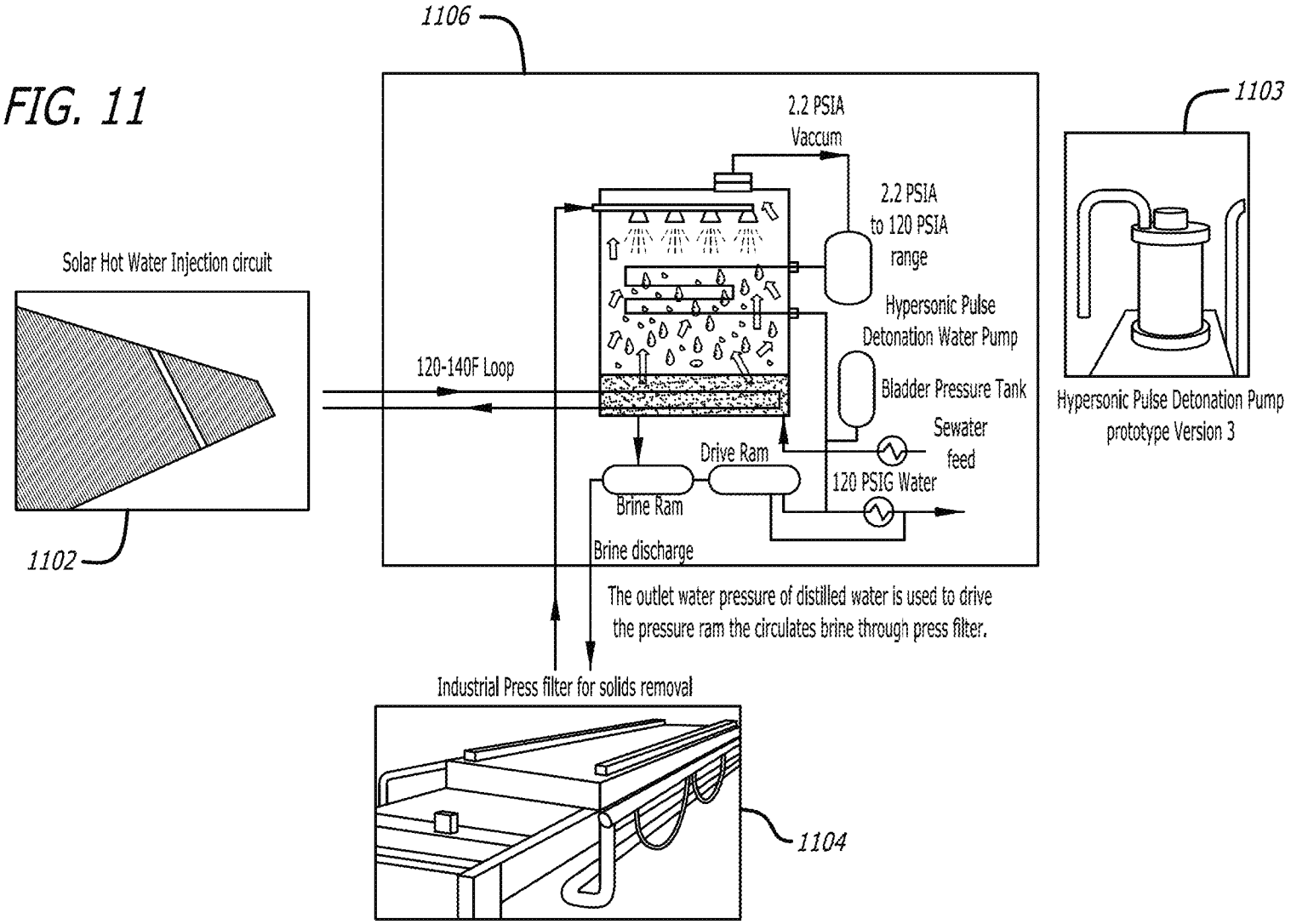
FIG. 11 illustrates a flash distillation process with a pulse detonation pump in accordance with embodiments of the invention.

In some embodiments of a pulse detonation pump both the cyclic and rotary detonation forms may be used to provide the desired pressures and vacuums to accomplish cost effective low pressure flash distillation of all types of water sources. In some embodiments the pump can be used for fluids including but not limited to saltwater, freshwater, brackish water, effluent, or sulfuric acid. Because of the lower energy requirements of the pump, the low pressure flash distillation process will fit well into the energy footprint of fluid transportation. In various embodiments a cyclic form of the pump can reach 2.2 psia on each cycle which correspondingly allows water to boil at 54° C. In other embodiments a rotary detonation form of the pump can lower this vacuum to 0.5 psia which correspondingly allows for water to boil at 27° C. FIG. 11 shows a low pressure flash distillation process utilizing a glycol loop solar array 1102 to raise the water temperature of a brine tank 1106. Although the solar array 1102 is shown, any other heat source may be substituted to bring the fluid to the desired temperature. The pump 1103 in both cyclic and rotary detonation modes is used to provide the hydraulic pressure to operate the press filter 1104 to routinely remove solids, and to recompress the steam back to a liquid. Although these temperatures and pressures are related to water, other fluids such as strong acids and bases not reactive with the fuel may benefit from this form of distillation or transport alone. It should be noted that the steam column created could be used to raise the discharge level of the pump to much higher elevations for storage purposes, Discharge could foreseeably be within municipal storage towers maintaining municipality supply pressures.

Figure 12:
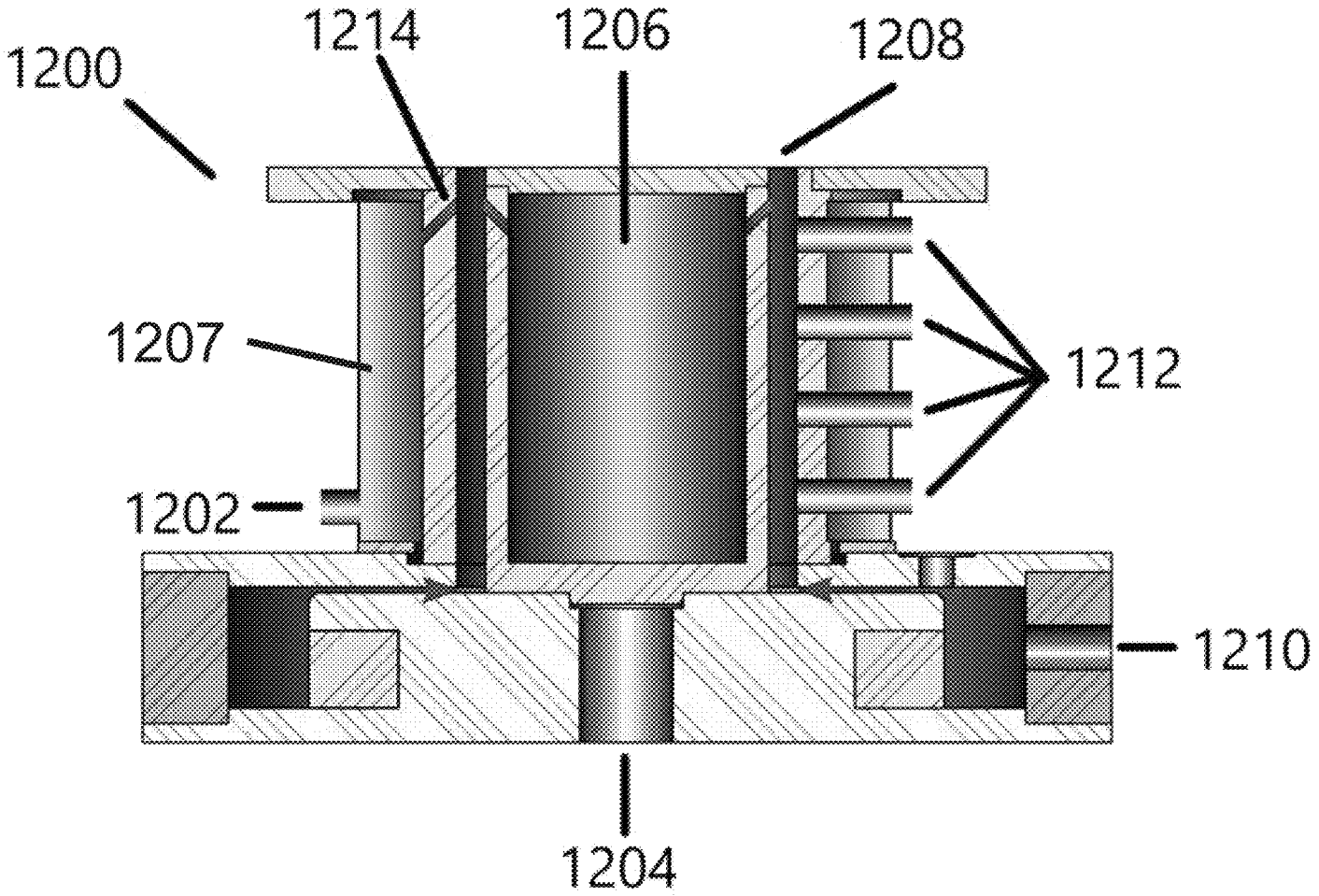
FIG. 12 illustrates a rotary detonation water pump in accordance with embodiments of the invention.

In numerous embodiments, a continuous thrust vector can be accomplished by utilizing rotary detonation. For example, FIG. 12 illustrates an embodiment of a rotary detonation pump 1200. It can be appreciated that the dynamics of a rotary detonation engine can produce vacuum and pressure in a manner that allows it to function like a pump. For example, numerous embodiments can be configured with one or more fluid inlets (1202 and 1204) that can be used to allow fluid to flow into the primary fluid gallery 1206 as well as a circumferential fluid reservoir 1207. In some embodiments, the fluid to be moved can also be used to absorb any excess heat generated from the combustion. Accordingly the absorption of heat can lead to the creation of steam and/or other gases that can be expelled through a number of outlet ports. Furthermore, some embodiments can be configured for the expulsion of a fluid in such a manner that the fluid is pushed to an alternate location. It can be appreciated that the input of fluid and subsequent absorption of heat can be used to shield the annulus 1208, outlet lines (not shown) and in the case of an aerospike linear engine, the spike. In numerous embodiments, the fluid inlets (1202 and 1204) can be configured to receive hydrogen and/or oxygen that can be heated, changed to a gas, and subsequently pushed to a larger pump or a pump that can utilize the now pressurized gas for the combustion process. This can be advantageous because smaller implementations of a rotary detonation pump can reduce the complexity and long term maintenance costs involved with pressurizing gases used for the function of the pump. In accordance with many embodiments, the rotary detonation pump 1200 may incorporate a combustion gas inlet 1210 that can provide the fully mixed gas and is protected from the backwards detonation pressure by a variable director (not pictured). As can be appreciated the gas supplied to the gas inlet 1210 can be supplied in a number of manners such as from a separate rotary combustion pump or by an alternative gas pressurization device.

The protection or shielding of the annulus 1208 from excessive heat can ensure a greater efficiency of the pump. Accordingly, some embodiments may use one or more sensors 1212 to monitor the temperature and pressure at various locations in the pump 1200. The temperature and pressure sensors 1212 can be used for recording operational parameters which can then be fed back into a control module (not shown) such that the various inlets (1202, 1204, and 1206) can be appropriately controlled to ensure the most efficient operation of the pump 1200. In numerous embodiments, the shape of the annulus 1208 can modified to re-enforce the period of rotation within the annulus. For example, in a cylindrical annulus the flame front furthest from the primary detonation point lags the flame front closest to the primary detonation point. In contrast, a conical annulus, if properly engineered, would result in a uniform flame front from the primary detonation point to the annulus exit. Additionally, fluid injection ports 1214 can be used in a simplified form around the annulus 1208 to aid in the absorption of heat during the process.

Although specific implementations of the rotary detonation and pulse detonation pumps are illustrated, it should be understood that a number of different configurations can be used in order to achieve the specific work cycles described herein such as combustion, expulsion of fluid and generation of vacuum, and a subsequent drawing in of fluids for a repeat process. Additionally, although each implementation is illustrated separately, it can be appreciated that a combination of such implementations can be used to perform the desired process.

DOCTRINE OF EQUIVALENTS

This description of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications. This description will enable others skilled in the art to best utilize and practice the invention in various embodiments and with various modifications as are suited to a particular use. The scope of the invention is defined by the following claims.

What is claimed is:

1. A process for generating a pumping force comprising:

introducing a volume of a fluid into a vessel defining a volume, the vessel having at least one fluid inlet and one fluid outlet, wherein the fluid includes at least water and is at least unreactive to hydrogen and oxygen;

introducing and igniting a detonation gas comprising an approximately stoichiometric mixture of hydrogen and oxygen within the vessel to induce a detonation of the detonation mixture, wherein the detonation produces a superheated steam and a hypersonic shockwave within the vessel, and wherein the superheated steam expands producing a pressure wave within the pressure vessel;

expelling via the pressure wave and hypersonic shockwave substantially all of the fluid from the vessel through the at least one fluid outlet such that only the superheated steam remains in the vessel after the expulsion;

condensing the superheated steam such that a vacuum state is created within the vessel; and repeating the introducing, igniting, expelling, and condensing steps such that an oscillating pressure is created within the vessel whereby a system pressure within the vessel increases during the igniting step to a high pressure state greater than atmospheric pressure and asymptotically decreases during the expelling and condensing steps to a vacuum state wherein the pressure within the vessel is lower than atmospheric pressure such that by the oscillation between high pressure and vacuum states the pumping force is produced.

2. The process of claim 1, wherein at least a portion of the water undergoes thermolysis to produce additional detonation mixture.

3. The process of claim 1, wherein the pumping force generated by the vacuum state within the vessel introduces the fluid into the vessel from a source.

4. The process of claim 1, wherein the fluid includes acids or bases.

5. The process of claim 1, wherein the mixture has a 2 to 1 ratio of hydrogen to oxygen.

6. The process of claim 1, wherein the pumping force is configured to act as a vacuum pump to lower pressure in an external volume.

7. The process of claim 1, wherein the pumping force is configured to act as a pressurizing pump to increase pressure in an external volume.

8. The process of claim 1, wherein the pumping force is configured to act as a fluid transfer pump to move the fluid between first and second external volumes.

9. The process of claim 1, wherein the process is distributed across a plurality of vessels.

10. The process of claim 1, wherein the introduction of the fluid pressurizes the detonation mixture prior to ignition and detonation.

11. The process of claim 10, wherein the expelled steam has at least a supersonic velocity; and further comprising, directing the expelled steam at a source of molten metal such that the molten metal is atomized to a plurality of metal particles.

12. The process of claim 11, further comprising applying a magnetic field to the atomized plurality of metal particles.

13. The process of claim 1, wherein the fluid includes gaseous water.

14. The process of claim 1, wherein the hypersonic shockwave has a speed of up to Mach 4.5 and a temperature of up to 2800° C.

15. The process of claim 1, wherein the superheated steam expands in volume up to 2000 times the original volume of the detonation gas.

16. The process of claim 1, wherein the pressure vessel forms a portion of a rotary detonation pump such that a continuous thrust vector can be induced from the pump force.

17. The process of claim 1, wherein the fluid ejected from the pump is selected from the group of steam, water, hydrogen and oxygen.

18. The process of claim 1, further comprising, prior to the introducing the fluid into the vessel, priming the vessel, the priming comprising:

introducing a detonation gas comprising an approximately stoichiometric mixture of hydrogen and oxygen into the vessel;

igniting the detonation gas to induce a detonation of the detonation gas, wherein the detonation produces a superheated steam and a hypersonic shockwave within the vessel, and wherein the superheated steam expands producing a pressure wave within the pressure vessel;

expelling via the pressure wave and hypersonic shockwave substantially all of a gaseous atmosphere from the vessel through the at least one fluid outlet such that only the superheated steam remains in the vessel after the expulsion; and condensing the superheated steam such that a vacuum state is created within the vessel.

19. A process of generating vacuum comprising:

receiving a determined amount of a detonation gas comprising an approximately stoichiometric mixture of hydrogen and oxygen into a chamber; and igniting the detonation gas producing a detonation in the chamber, such that at least superheated steam and a hypersonic shockwave are produced, thereby generating an increasing pressure wave within the chamber expelling any fluid within the chamber out of an exit valve such that only the superheated steam remains in the chamber after the expulsion; and condensing the superheated steam such that the pressure inside the chamber asymptotically decreases below the pressure outside the chamber thereby creating a vacuum within the chamber.

20. A process of pumping fluids comprising:

providing a pump wherein the pump comprises a chamber having an exterior portion and an interior portion wherein the interior portion forms an internal space, at least one fluid inlet assembly in fluid communication with the interior portion of the chamber having a portion thereof connected to the exterior portion of the chamber;

a gas inlet assembly in fluid communication with the interior portion of the chamber and connected to the exterior portion and configured to transfer a detonation gas comprising an approximately stoichiometric mixture of hydrogen and oxygen into the internal portion of the chamber;

an ignitor assembly connected to the exterior portion of the chamber and wherein a section of the ignitor assembly is exposed to the interior portion of the chamber and wherein the ignitor assembly contains an ignitor;

receiving a fluid into the chamber through the fluid inlet assembly;

receiving the detonation gas into the chamber through the gas inlet assembly;

igniting the detonation gas by activation of the ignitor thereby producing a detonation of the detonation gas such that at least superheated steam and a hypersonic shockwave are produced, thereby generating an increasing pressure wave within the chamber thereby expelling the fluid out of the chamber through an outlet valve connected to a portion of the chamber such that only the superheated steam remains in the chamber after the expulsion; and condensing the superheated steam, wherein the detonation of the detonation gas, expulsion of the fluid, and condensation of the superheated steam within the chamber asymptotically decreases the pressure generating a vacuum within the chamber thereby impelling additional fluid into the chamber through the at least one fluid inlet assembly.

* * * * *